US009615677B2

(12) United States Patent
Trinh et al.

(10) Patent No.: US 9,615,677 B2
(45) Date of Patent: Apr. 11, 2017

(54) RETAIL FIXTURE WITH SLOT

(71) Applicant: Target Brands, Inc., Minneapolis, MN (US)

(72) Inventors: Nick Q. Trinh, Minneapolis, MN (US); Robert D. Peota, Minneapolis, MN (US); Judd S. Kivi, Minneapolis, MN (US); Timothy J. Martell, Brooklyn Park, MN (US); Robert P. Stoltz, Edina, MN (US); Thomas A. Schneider, Circle Pines, MN (US); Alex K. Poniatowski, Brooklyn Park, MN (US); Jennifer A. Theisen, Crystal, MN (US); William Y. Stafford, Minnetrista, MN (US); Daniel Adam Breunig, Irvine, CA (US); Kevin Huljich, Waitakere (NZ)

(73) Assignee: Target Brands, Inc., Minneapolis, MN (US)

( * ) Notice: Subject to any disclaimer, the term of this patent is extended or adjusted under 35 U.S.C. 154(b) by 147 days.

(21) Appl. No.: 14/186,277

(22) Filed: Feb. 21, 2014

(65) Prior Publication Data

US 2015/0243193 A1 Aug. 27, 2015

(51) Int. Cl.

| | |
|---|---|
| ***A47F 5/02*** | (2006.01) |
| ***A47F 5/00*** | (2006.01) |
| ***A47F 5/08*** | (2006.01) |

(52) U.S. Cl.

CPC ..... *A47F 5/0087* (2013.01); *A47F 5/0043* (2013.01); *A47F 5/0846* (2013.01); *A47F 5/0869* (2013.01)

(58) Field of Classification Search

CPC ..... A47F 1/126; A47F 5/0087; A47F 5/0025; A47F 5/13; A47F 3/002; A47F 5/12;

(Continued)

(56) References Cited

U.S. PATENT DOCUMENTS 554,574 A 2/1896 Bennett
2,264,419 A * 12/1941 Unger ..... A47B 19/04 248/137

(Continued)

OTHER PUBLICATIONS

Office Action from Canadian Patent Application No. 155938, mailed Nov. 18, 2014 (6 pages).

(Continued)

*Primary Examiner* — Leslie A Nicholson, III
*Assistant Examiner* — Kimberley S Wright
(74) *Attorney, Agent, or Firm* — Leanne Taveggia Farrell; Westman, Champlin & Koehler, P.A.

(57) ABSTRACT

A retail fixture includes a platform having a plurality of openings and a cover having at least one slot where the cover is positioned over the platform such that each of the at least one slots of the cover is aligned with an opening of the platform. A set of spaced-apart nubs extends along at least one opening. A bracket extends across the plurality of openings and is mounted to a bottom surface of the platform. The bracket has channels aligned with the openings. Each channel has a first width proximate the bottom surface and a second width distal from the bottom surface wherein the second width is wider than the first width.

20 Claims, 28 Drawing Sheets

(58) Field of Classification Search
CPC ..... A47F 7/024; A47F 7/0286; A47F 5/0043; A47F 5/0046; A47F 5/0861
See application file for complete search history.

(56) References Cited

U.S. PATENT DOCUMENTS 2,846,284 A 8/1958 Fitzgerald
3,181,703 A * 5/1965 Dunham ..... A47F 5/0025 211/133.3
3,224,661 A 12/1965 Tilton, Jr.
3,385,453 A 5/1968 Dantino et al.
3,933,399 A * 1/1976 Kolbensvik ..... A47F 3/00 312/196
3,964,603 A * 6/1976 Sandler ..... A47F 7/024 206/560
4,191,296 A 3/1980 Morgan
4,401,223 A 8/1983 Spamer
5,022,539 A 6/1991 Rushing et al.
5,119,942 A * 6/1992 McCullars ..... B07C 7/00 211/10
5,344,033 A 9/1994 Herman
5,348,383 A * 9/1994 Ritt ..... A47F 3/005 312/138.1
5,407,261 A * 4/1995 Mercer ..... A47B 46/005 312/245
5,477,970 A * 12/1995 Watt ..... A47F 5/13 211/175
5,531,159 A * 7/1996 Stubblefield ..... A47F 5/0093 108/100
5,553,724 A 9/1996 Moher et al.
5,584,402 A * 12/1996 Johnson ..... A47F 9/042 206/554
5,590,796 A * 1/1997 Herman ..... A47F 5/108 108/99
5,599,079 A 2/1997 Ranno et al.
5,711,435 A * 1/1998 Morison ..... A47F 7/0028 211/90.01
D390,728 S * 2/1998 Herman ..... D34/21
5,715,957 A * 2/1998 Merl ..... A47F 5/10 211/187
5,730,068 A * 3/1998 Rioux, Jr. ..... A47F 5/10 108/3
5,868,263 A * 2/1999 McAllister ..... A47B 57/485 108/108
5,875,902 A * 3/1999 Emery ..... A47F 5/13 108/29
5,897,005 A * 4/1999 Bernens ..... A47F 5/0815 211/189
5,992,651 A * 11/1999 Shaw ..... A47F 5/13 211/59.2
RE36,638 E * 4/2000 Herman ..... A47F 5/108 108/99
6,068,139 A * 5/2000 Brozak, Jr. ..... A47F 1/12 211/169
6,089,387 A * 7/2000 Varfolomeeva ..... A47B 57/06 211/106
6,267,258 B1 * 7/2001 Wilkerson ..... A47F 5/0025 211/119.003
6,375,015 B1 * 4/2002 Wingate ..... A47F 1/126 211/175
6,607,122 B1 8/2003 Ong
6,745,588 B2 * 6/2004 Kahler ..... A47F 3/0486 211/169.1
6,749,168 B2 * 6/2004 Johnson ..... G09F 19/08 248/349.1
6,752,277 B1 * 6/2004 Sempliner ..... A47F 1/126 211/1.57
7,171,909 B2 * 2/2007 Alt ..... A47F 5/12 108/7
7,175,034 B2 * 2/2007 Nook ..... A47F 5/0807 211/189
D540,566 S * 4/2007 Scholen ..... D6/672
7,287,652 B2 * 10/2007 Scholen ..... A47F 7/02 211/26
7,311,212 B2 * 12/2007 Martin ..... A47F 5/0018 211/150
7,316,378 B1 * 1/2008 Curran ..... A47F 5/0068 248/298.1
7,340,855 B2 * 3/2008 Wiltfang ..... G09F 3/204 248/220.21
D609,510 S * 2/2010 Stafford ..... D6/705
7,654,399 B2 * 2/2010 Scholen ..... A47F 7/02 211/26
7,661,545 B2 * 2/2010 Hardy ..... A47F 1/125 211/134
7,757,890 B2 * 7/2010 Alford ..... G07F 11/18 221/151
7,882,969 B2 * 2/2011 Gerstner ..... A47F 3/14 211/119.003
7,909,234 B2 3/2011 Maistrellis
7,963,383 B2 6/2011 Stingel, III et al.
8,051,783 B1 * 11/2011 Hoskinson ..... A47B 37/00 108/23
8,056,734 B2 * 11/2011 Menz ..... A47F 1/12 211/59.2
8,056,740 B2 * 11/2011 Weshler ..... A47F 7/024 211/119.003
8,087,522 B2 * 1/2012 Stafford ..... A47F 5/0025 108/108
8,172,096 B2 5/2012 Van De Steen
8,176,666 B2 * 5/2012 Martin ..... G09F 3/204 40/308
8,186,522 B2 * 5/2012 Weshler ..... A47F 7/024 211/119.003
8,231,017 B2 * 7/2012 Clontz ..... A47B 96/02 211/134
8,235,222 B2 * 8/2012 Hardy ..... A47F 3/002 211/183
8,256,628 B2 * 9/2012 Stafford ..... A47F 5/0025 108/108
8,360,373 B2 * 1/2013 Johnson ..... A47F 7/024 211/26
8,413,821 B2 4/2013 Johnson et al.
8,522,985 B2 * 9/2013 Scholen ..... A47F 7/02 211/26
8,523,122 B2 * 9/2013 Johnson ..... A47F 7/024 211/26
8,550,265 B2 * 10/2013 Botkin ..... A47B 96/067 211/106.01
8,579,125 B2 * 11/2013 Trinh ..... A47F 7/286 206/560
8,607,970 B2 * 12/2013 De Lecce ..... A47F 7/024 206/566
8,662,320 B2 * 3/2014 Csak ..... A47F 5/0087 211/59.3
8,671,853 B2 * 3/2014 Flaherty ..... A47B 9/18 108/138
8,711,553 B2 * 4/2014 Trinh ..... A47F 7/0246 248/206.5
8,925,745 B2 * 1/2015 Theisen ..... F21V 33/00 211/10
8,994,798 B2 * 3/2015 Trinh ..... H04N 13/0438 348/54
9,030,322 B2 * 5/2015 Johnson ..... A47F 3/002 340/568.2
D736,020 S * 8/2015 Martell ..... D6/702
9,101,230 B2 * 8/2015 Sosso ..... A47F 1/126
9,125,501 B2 * 9/2015 Reynolds ..... A47F 7/024
D740,594 S * 10/2015 Trinh ..... D6/672
9,307,847 B2 * 4/2016 De Lecce ..... A47F 3/14
9,384,684 B2 * 7/2016 Theisen ..... F21V 33/00
2002/0166275 A1 * 11/2002 Broadwell ..... G09F 3/20 40/607.1
2002/0174581 A1 * 11/2002 Johnson ..... G09F 19/08 40/473
2003/0230095 A1 * 12/2003 Kahler ..... A47F 3/0486 62/155

(56) References Cited

U.S. PATENT DOCUMENTS

2004/0060884 A1* 4/2004 Nook ..... A47F 5/0807 211/189
2004/0222171 A1* 11/2004 Johnson ..... G09F 19/08 211/1.52
2005/0067362 A1* 3/2005 Martin ..... A47F 5/0018 211/87.01
2005/0247649 A1* 11/2005 Scholen ..... A47F 7/02 211/26
2007/0235506 A1 10/2007 Shapiro
2007/0272631 A1* 11/2007 Scholen ..... A47F 5/0846 211/26
2007/0272634 A1* 11/2007 Richter ..... A47F 1/126 211/59.3
2009/0294390 A1* 12/2009 Weshler ..... A47F 7/024 211/119.003
2009/0294392 A1* 12/2009 Stafford ..... A47F 5/0025 211/153
2010/0012600 A1* 1/2010 Clontz ..... A47F 5/0043 211/26
2010/0133209 A1* 6/2010 Scholen ..... A47F 7/02 211/26
2011/0062294 A1* 3/2011 Johnson ..... A47F 7/024 248/161
2011/0210654 A1 9/2011 Edison Zatz et al.
2011/0266232 A1* 11/2011 Kahler ..... A47F 5/0043 211/26
2012/0000872 A1 1/2012 Troyner et al.
2012/0037578 A1* 2/2012 Weshler ..... A47F 7/024 211/59.3
2012/0084961 A1* 4/2012 Stafford ..... A47F 5/0025 29/428
2012/0085717 A1* 4/2012 Trinh ..... A47F 7/286 211/59.2
2012/0285911 A1 11/2012 Valiulis
2013/0128013 A1* 5/2013 Trinh ..... H04N 13/0438 348/54
2013/0213911 A1* 8/2013 Theisen ..... A47F 5/0025 211/59.4
2013/0299363 A1* 11/2013 De Lecce ..... A47F 7/024 206/6.1
2013/0327733 A1* 12/2013 Csak ..... A47F 5/0087 211/59.3
2014/0061218 A1* 3/2014 Vogler ..... A47F 1/126 221/1
2014/0250749 A1* 9/2014 Theisen ..... F21V 33/00 40/649
2014/0305891 A1* 10/2014 Vogler ..... A47F 1/125 211/59.3
2014/0319086 A1* 10/2014 Sosso ..... A47F 1/125 211/59.3
2015/0173529 A1* 6/2015 Hester-Redmond .. A47F 5/0018 211/59.3

OTHER PUBLICATIONS

U.S. Appl. No. 29/482,747, filed Feb. 21, 2014, entitled Display Apparatus, 17 pages.

* cited by examiner

RETAIL FIXTURE WITH SLOT

BACKGROUND

Retail stores use a variety of display fixtures to present products to customers for purchase. These display fixtures can support the product, indicate the product price and include signage, graphics and lighting for highlighting the product. Exemplary display structures include shelves, trays, racks, peg hooks, tables and other similar structures.

The discussion above is merely provided for general background information and is not intended to be used as an aid in determining the scope of the claimed subject matter. The claimed subject matter is not limited to implementations that solve any or all disadvantages noted in the background.

SUMMARY

A retail fixture includes a platform having a plurality of openings and a cover having at least one slot where the cover is positioned over the platform such that each of the at least one slots of the cover is aligned with an opening of the platform.

A product support for a retail display includes a top surface having at least one opening, a bottom surface opposite the top surface, and a set of spaced-apart nubs extending along at least one opening on the bottom surface.

A retail display structure has a support structure with an opening between a top surface and a bottom surface. A bracket extends across the opening and is mounted to the bottom surface of the support structure. The bracket has a channel aligned with the opening and has a first width proximate the bottom surface and a second width distal from the bottom surface wherein the second width is wider than the first width.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Embodiments described below provide retail fixtures that have substantially planar surfaces with one or more slots in the surfaces that can be used to mount product posts or holders to the fixture. In some embodiments, the retail fixture includes a platform having multiple openings and a cover over the top surface of the platform with one or more slots that are aligned with the openings of the platform. This allows the display fixture to be reconfigured by replacing the cover with a cover that has a different number or different combination of slots. Thus, the display structure can be provided with one, two or three slots simply by changing the cover on the display structure.

In some embodiments, a series of spaced apart nubs or positioning keys are provided beneath the platform along each opening to define positions where a product post may be attached to the display structure. The product post is fastened using a fastening mechanism that includes elements that are wider than the opening. In accordance with one embodiment, one or more brackets that span these openings have channels that are wide enough to accommodate the fastening mechanism.

Some embodiments include a label holder at the front of the display fixture that is in the same plane as a top surface of the cover and is supported in part by a portion of the cover.

In some embodiments, the platform and the cover can be raised relative to a base of the retail fixture through a linkage connected to the base and the platform. In accordance with some embodiments, the linkage includes a locking mechanism or catch that must be released in order for the platform to be moved back down to the base. This helps to prevent the platform from accidentally falling. In the raised position, it is possible to fasten product posts or supports to the platform and to manage power cords placed under the platform for products that are powered while on the retail fixture. In accordance with some embodiments, the retail fixture includes one or more holders that support power transformers and/or power strips. In accordance with one embodiment, a holder for holding power transformers is mounted beneath a bottom surface of the platform.

Figure 1:
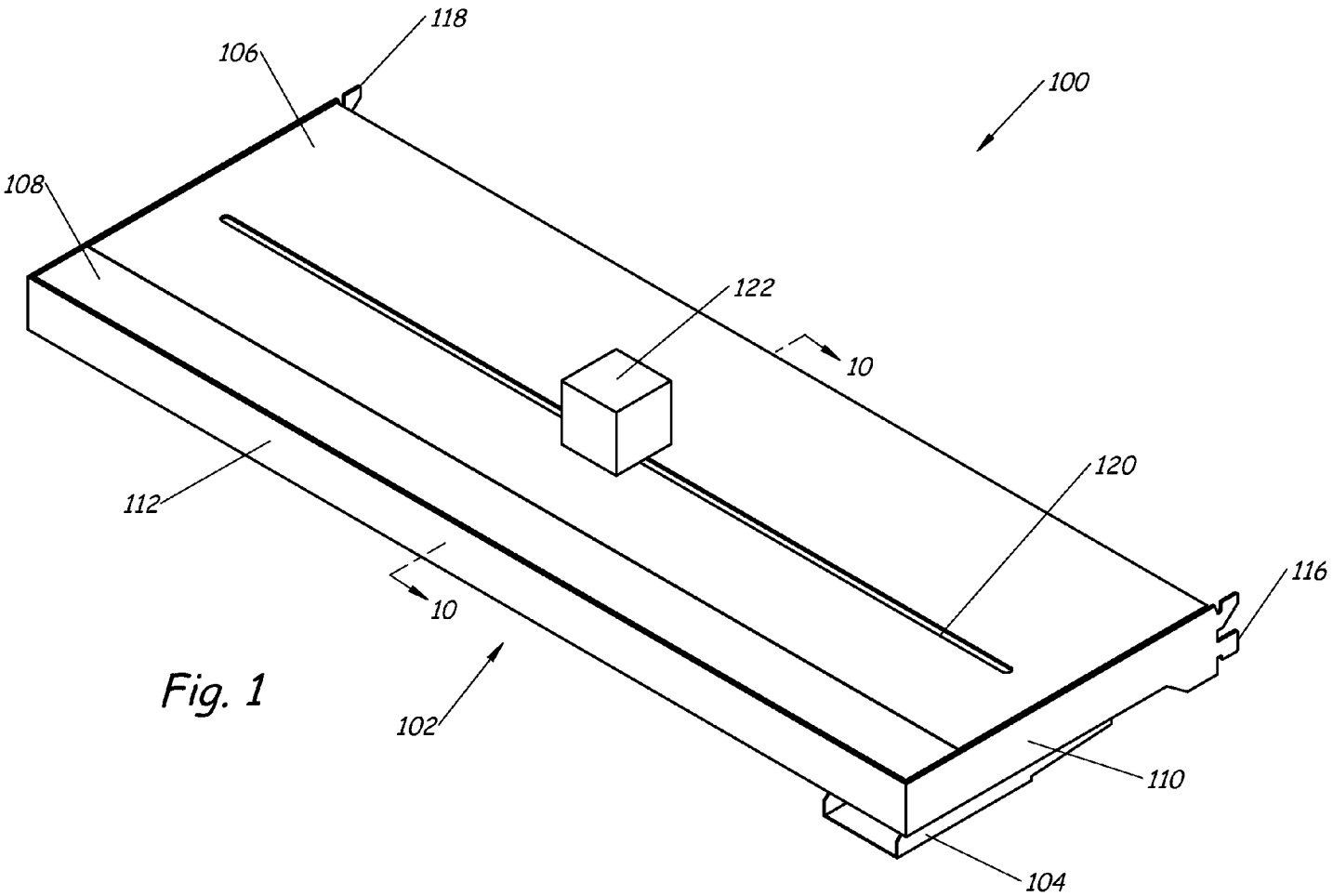
FIG. 1 provides a front perspective view of a first embodiment of a retail fixture.
Figure 2:
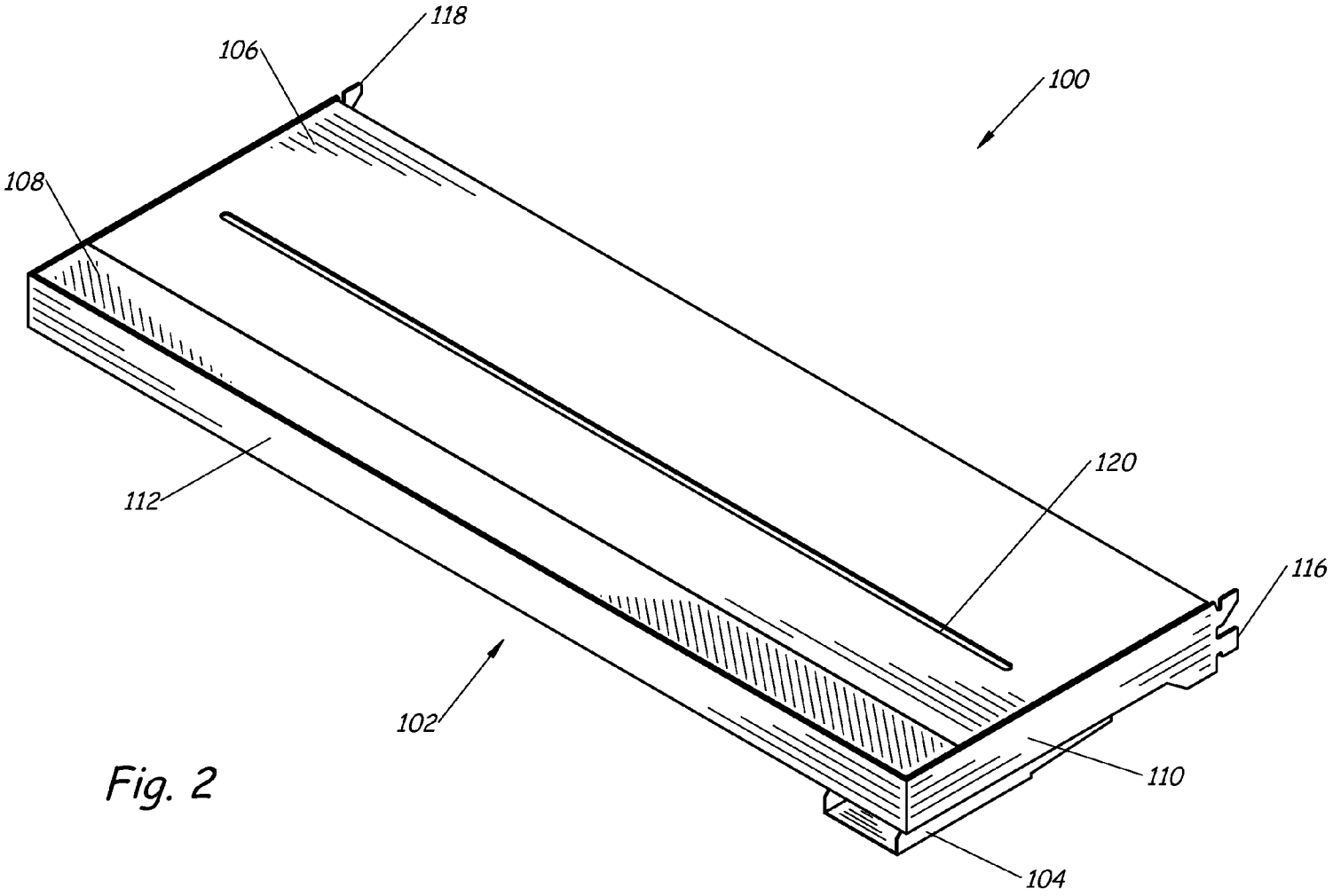
FIG. 2 provides a front perspective view of the retail fixture of FIG. 1 without a product post.
Figure 3:
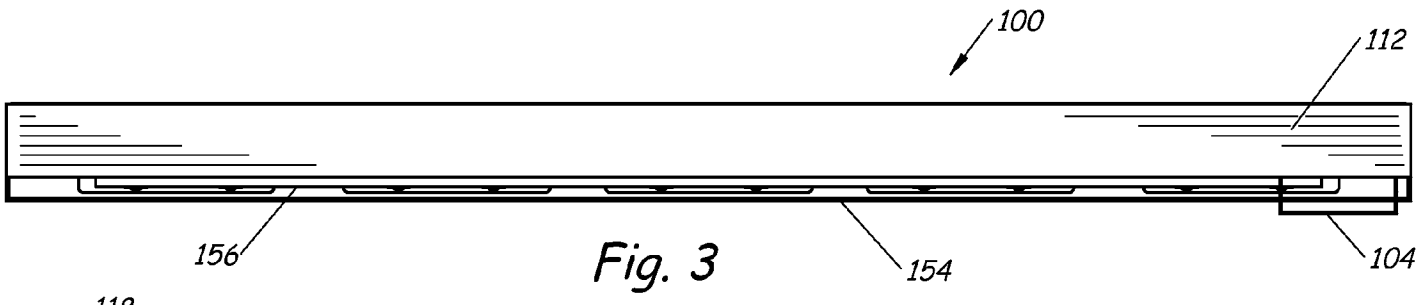
FIG. 3 provides a front view of the retail fixture of FIG. 2.
Figure 4:
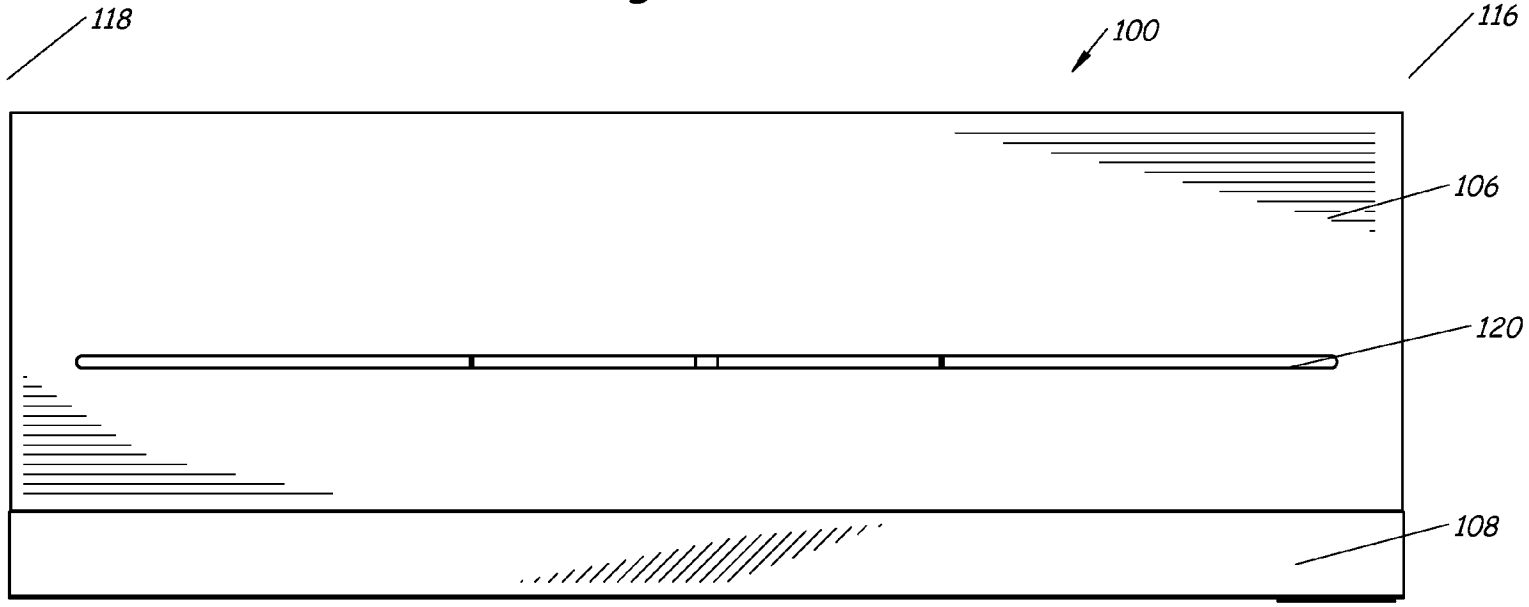
FIG. 4 provides a top view of the retail fixture of FIG. 2.
Figure 5:
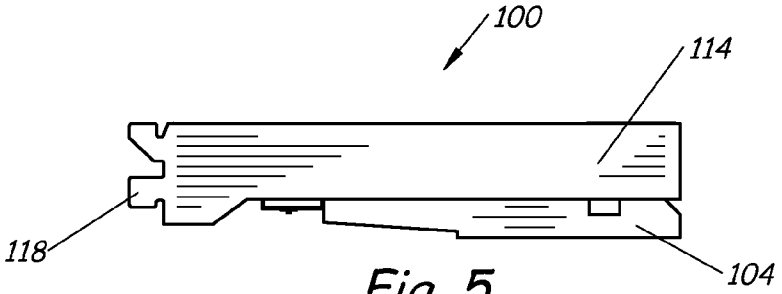
FIG. 5 provides a right side view of the retail fixture of FIG. 2.
Figure 6:
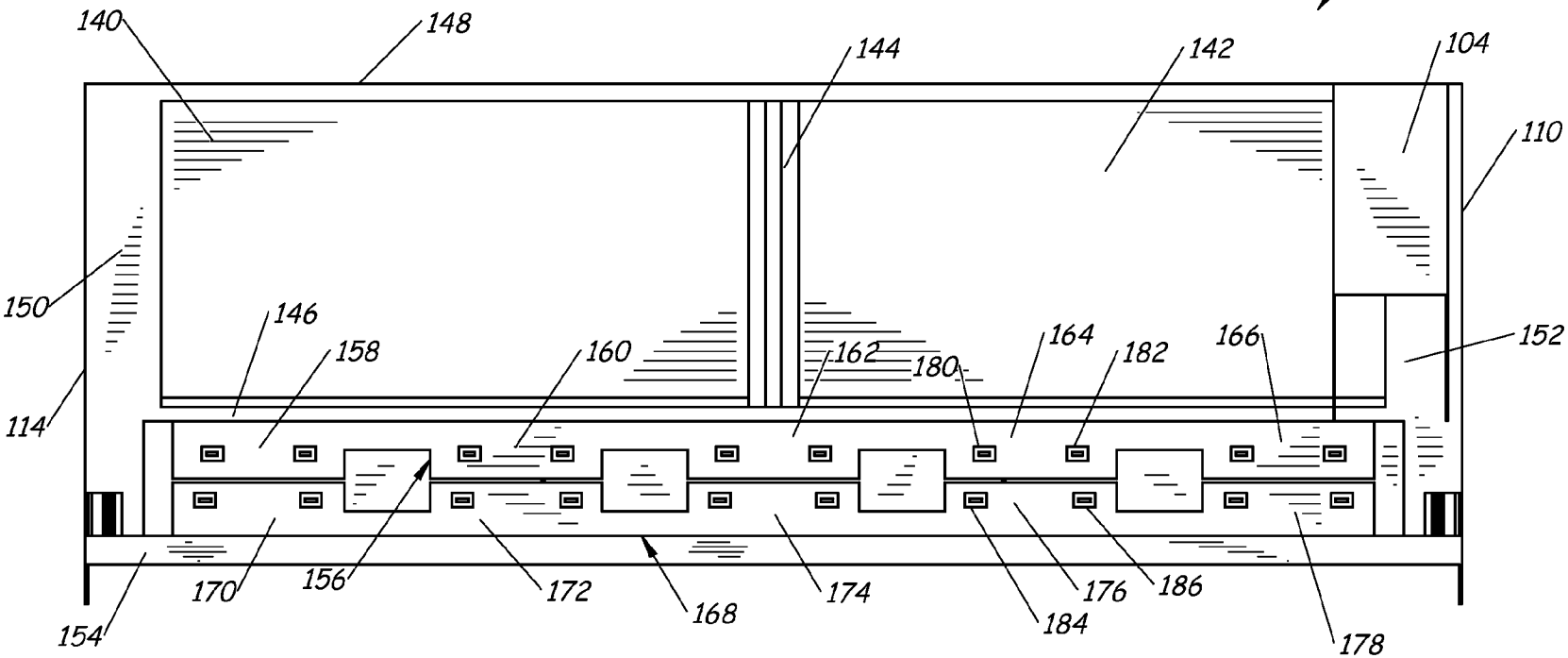
FIG. 6 provides a bottom view of the retail fixture of FIG. 2
Figure 7:
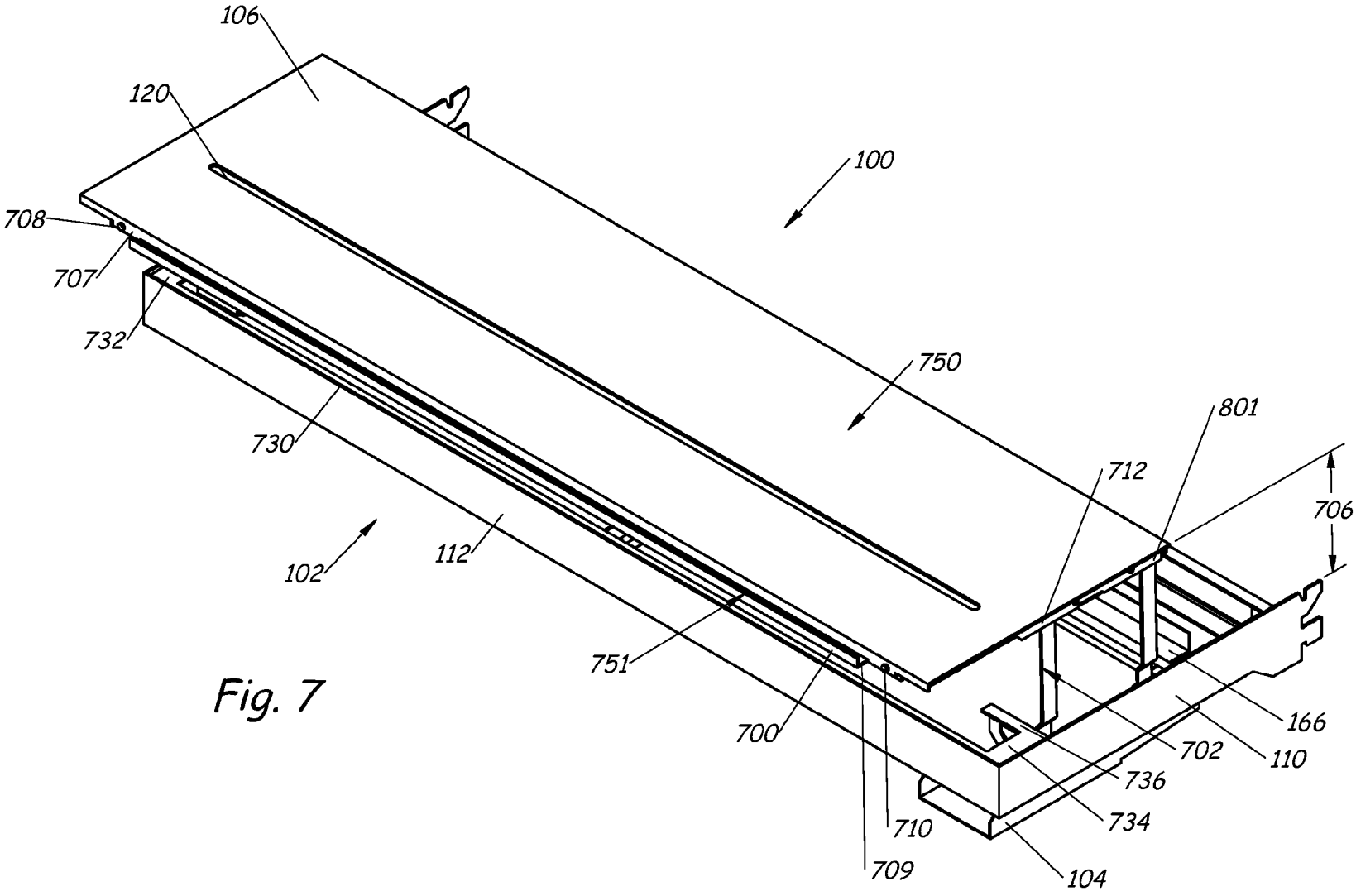
FIG. 7 provides a perspective view of the retail fixture of FIG. 2 with its platform in a raised position.
Figure 8:
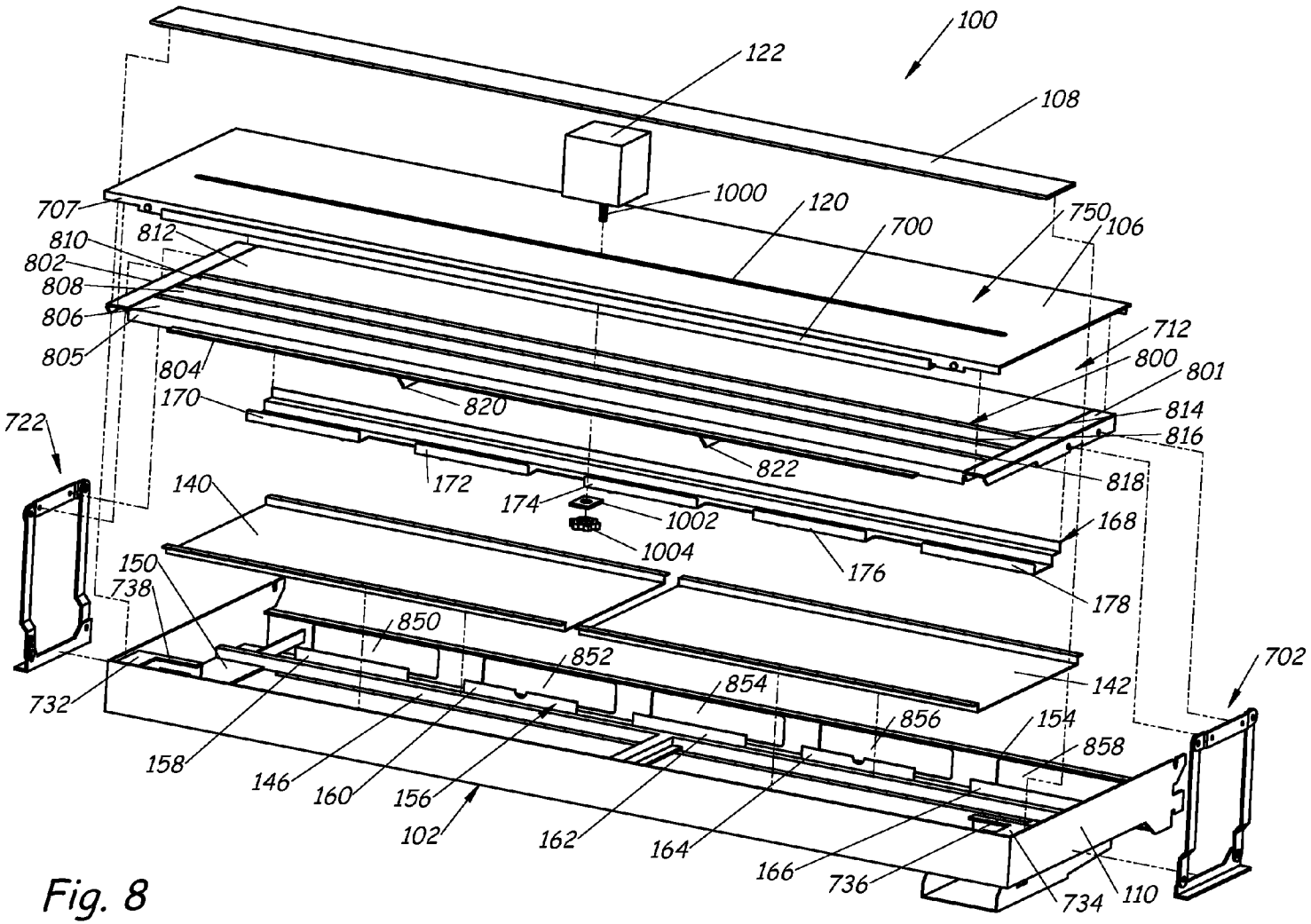
FIG. 8 provides a top perspective exploded view of the retail fixture of FIG. 2.
Figure 9:
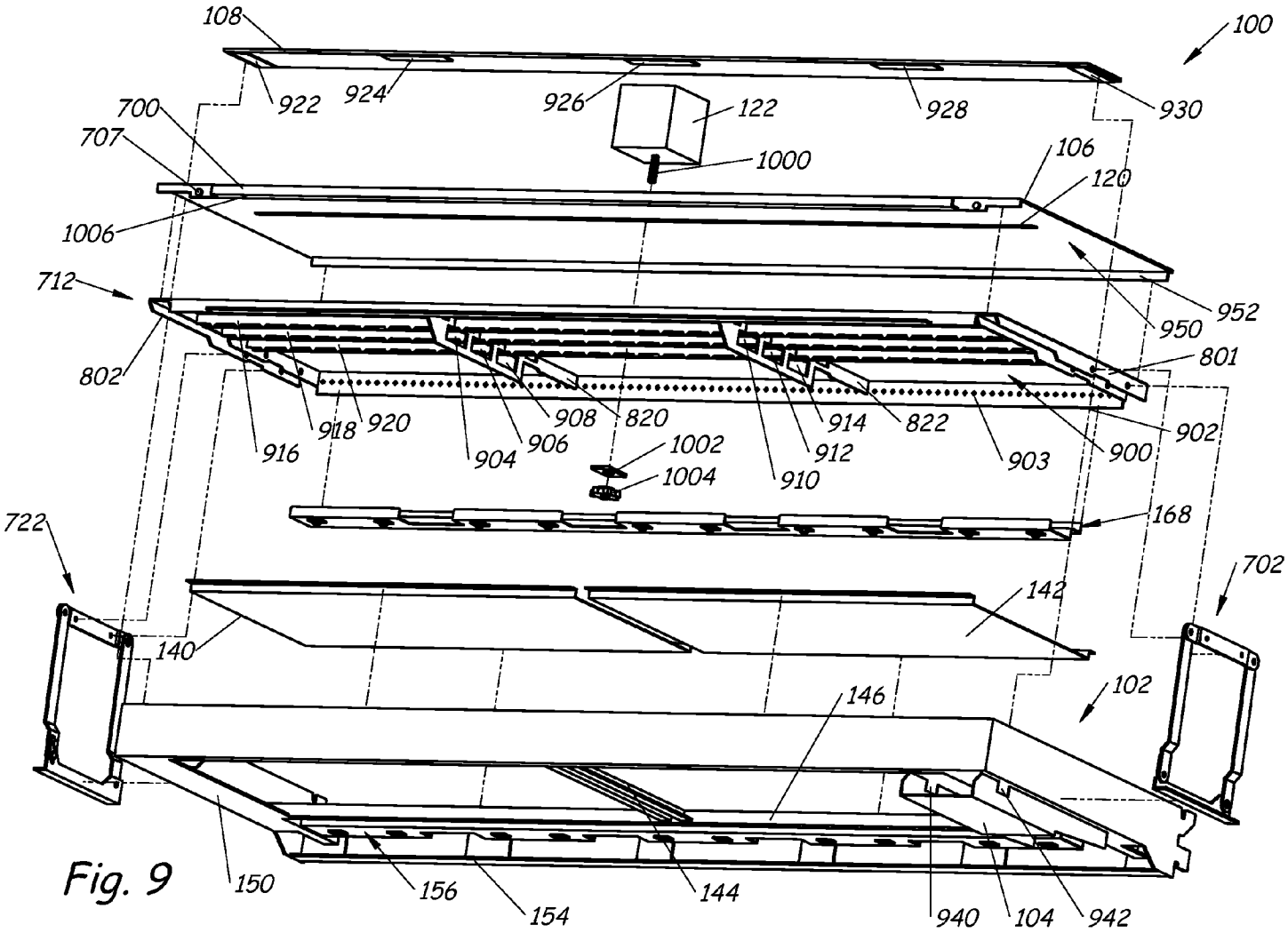
FIG. 9 provides a bottom perspective exploded view of the retail fixture of FIG. 2.

FIG. 1 provides a front perspective view of a retail fixture/product support/retail display structure 100 with a product post 122 mounted to it. FIG. 2 provides a front perspective view of retail fixture 100 of FIG. 1 without product post 122. FIGS. 3, 4, 5 and 6 provide a front view, top view, left side view, and bottom view of retail fixture 100. The right side view of retail fixture 100 is a mirror image of the view illustrated in FIG. 5. FIG. 7 provides a perspective view of retail fixture 100 of FIG. 2 with its platform in a raised position. FIG. 8 provides a top perspective exploded view of retail fixture 100 of FIG. 1 and FIG. 9 provides a bottom perspective exploded view of retail fixture 100 of FIG. 1.

Retail fixture 100 includes a base 102, an information holder 104, a platform 712 (FIGS. 7-9), a cover or overlay 106 with a slot 120, and a label holder 108. Base 102 includes a right side 110, a front 112, a left side 114 (FIG. 5) and a back rail 154 (FIGS. 6, 8 and 9). Right side 110 includes a mounting bracket 116 and left side 114 includes a mounting bracket 118 shaped to be mounted to uprights of retail display structures. Brackets 116 and 118 lock into the uprights and support retail fixture 100 so that retail fixture 100 appears as a shelf. Information holder 104 is an optional element provided to hold printed materials related to the products displayed on retail fixture 100. Back rail 154 has a generally C-shaped profile with a top ledge, a bottom ledge and a back member connecting the top ledge to the bottom ledge. The back member has openings 850, 852, 854, 856, and 858 (FIG. 8), through which one or more cables or cords are passed such as power cords, data cables and coaxial cables, for example.

As shown in the bottom view of FIG. 6, base 102 also includes bottom trays 140 and 142, middle rail 146, front rail 148, side support member 150, side support member 152, and middle support member 144. Side support members 150 and 152 extend between front rail 148 and back rail 154. Middle rail 146 extends between side support members 150 and 152 and is raised relative to side support members 150 and 152. In accordance with one embodiment, middle rail 146 has a substantially square cross-section. Middle support member 144 extends from front rail 148 to middle rail 146 and has a raised center portion between two planar portions that each extend from front rail 148 to middle rail 146.

Information holder 104 is mounted to side support member 152 and front rail 148. As shown in FIG. 9, printed material holder 104 includes two openings 940 and 942 between printed material holder 104 and base 102. Openings 940 and 942 are aligned and sized to accommodate a light strip that can extend the entire width of base 102 and thereby provide lighting below base 102.

Tray 142 of base 102 is supported by middle rail 146, front rail 148, side support member 152 and middle support member 144. Tray 140 is supported by middle rail 146, front rail 148, side support member 150 and middle support member 144. Trays 140 and 142 support materials stored within retail fixture 100 such as power cords and power transformers, additional product posts, alarm management tools, product brochures, and labels, for example.

Retail fixture 100 also includes holders 156 and 168 (FIGS. 6, 8 and 9) that can support multiple power transformers. Holder 156 includes cradles 158, 160, 162, 164 and 166 (FIGS. 6 and 8), which are each sized to support a power transformer such as an AC-to-DC power transformer on their upper surface. Similarly, holder 168 includes cradles 170, 172, 174, 176 and 178 (FIGS. 6 and 8), which each can hold a power transformer, such as an AC-to-DC power transformer, on their upper surface. Holder 156 is mounted to middle rail 146 of base 102 and holder 168 is mounted to a back 902 (FIG. 9) of platform 712 by passing fasteners through holes 903 in back 902. Power transformers held in cradles 170, 172, 174, 176 and 178 are thus positioned between bottom surface 900 of platform 712 and support bracket 168.

In accordance with some embodiments, each power transformer converts line power to power levels that are used by a product displayed on retail fixture 100. A conductor extends from each power transformer to a respective product on retail fixture 100 by passing the conductor through the one of the slots in cover 106 or through one of the openings 850, 852, 854, 856, and 858 in back rail 154 of base 102. A second respective conductor extends from an outlet to each power transformer. In accordance with some embodiments, the outlet is external to retail fixture 100, in which case the second conductor extends through one of openings 850, 852, 854, 856, and 858. In other embodiments, the outlet is formed in a power strip that is mounted between the top ledge and the bottom ledge of back rail 154. Such a power strip is plugged into an external outlet and provides multiple power outlets that can be used as power sources for multiple products displayed on retail fixture 100.

The various power cords and other cables found inside and below retail fixture 100 can be organized using eyelets that extend down from a bottom surface of platform 712 and from the bottom surfaces of the cradles of holders 156 and 168. For example, in FIG. 6, cradle 164 is shown to have eyelets 180 and 182 and cradle 176 is shown to have eyelets 184 and 186. The eyelets can be used to support zip ties that are used to collect power cords and other cables so that the cords and cables are better organized.

Cover or overlay 106 has a top surface 750, a front surface 707, a lateral extension 709 and a vertical extension 700. Cover 106 is attached to platform 712 using two fasteners 708 and 710. A back surface 952 of cover 106 covers a portion of back 902 of platform 712. Cover 106 may be constructed of metal, plastic or wood or other fibrous material. Cover 106 may have a same color and finish as platform 712 and base 102 or may have a different appearance. For example, in accordance with some embodiments, cover 106 appears to have a wood grain while the remainder of retail fixture 100 is constructed of metal.

Label holder 108 is supported by base 102 and cover 106. In particular, a front label support structure 730, a left side label support structure 732, a partial back label support structure 738, a right side label support structure 734 and a partial back label support structure 736 of base 102 supports a portion of label holder 108. Lateral extension 709 and vertical extension 700 of cover 106, which together form a label support structure or sign support structure 751, support the remainder of price label holder 108. In accordance with some embodiments, a top surface of vertical extension 700 is in a same plane as the top surfaces of label support structures 730, 732, 734, 736 and 738 when platform 712 is in a lowered position. Label holder 108 includes magnets 922, 924, 926, 928 and 930, which are adhered along a bottom surface of label holder 108 and which provide a releasable connection to base 102.

In the exploded views of FIGS. 8 and 9, elements of platform 712 can be seen in more detail. Platform 712, also referred to as a support structure, includes lateral members 806, 808, 810 and 812, which extend between ends 801 and 802. Members 806 and 808 are separated by a distance forming a slot or opening 818; members 808 and 810 are separated by a distance forming a slot or opening 816; and members 810 and 812 are separated by a distance forming a slot or opening 814. Openings 814, 816 and 818 are parallel to each other and each extends between ends 801 and 802 and between a top surface and a bottom surface of platform 712. In the embodiment of FIG. 8, slot 120 of cover 106 is aligned with opening 816 of platform 712. As described further below, different numbers of slots and different positions for the slots in cover 106 may be provided to expose different combinations of openings 814, 816 and 818. In addition, although slot 120 is shown as an elongated slot, in other embodiments slot 120 has other shapes such as a round hole, for example. Further, although only a single slot is shown aligned with opening 816, in other embodiments multiple separate slots are aligned with opening 816 with each slot having a same shape as the other slots aligned with opening 816 or with one or more of the slots having different shapes. Thus by replacing cover 106 with a cover that has a different number of slots, different shaped slots or a different combination of slots, the appearance of retail fixture 100 may be changed and thus the configuration of product posts on retail fixture 100 may be changed.

Each lateral member 806, 808, 810 and 812 and ends 801 and 802 have top surfaces that are substantially coplanar with each other forming an overall planar top surface 800 for platform 712. A bottom surface 950 of cover 106 overlays and comes into contact with top planar surface 800 of platform 712.

Lateral member 806 includes a front surface 805 extending downward from the top surface and a forward projecting element 804 extending forward from front surface 805. Forward projecting element 804 provides support for lateral extension 709 of cover 106 as shown in more detail below. Each of lateral members 806, 808 and 810 includes a respective downwardly extending protrusion 916, 918 and 920 (FIG. 9) consisting of a set or series of position keys also referred to as a set or series of spaced-apart nubs. In the embodiment of FIG. 9, downwardly extending protrusions 916, 918 and 920 are formed integrally with lateral members 806, 808 and 810, respectively. In other embodiments, downwardly extending protrusions 916, 918 and 920 are welded to the bottom surfaces of lateral members 806, 808 and 810. Each of downwardly extending protrusions 916, 918, and 920 and their respective sets of spaced-apart nubs or position keys, extend along a separate opening in platform 712.

Platform 712 also includes supports or brackets 820 and 822 that extend transversely to openings 814, 816 and 818 and are attached to bottom surface 900 of platform 712. In accordance with one embodiment, supports 820 and 822 are welded to the bottom surface of each lateral member 806, 808, 810 and 812. Support 820 includes openings or channels 904, 906 and 908, which are aligned with and open into openings 818, 816 and 814, respectively. Similarly, support 822 includes openings or channels 910, 912 and 914, which are aligned with and open into respective openings 818, 816 and 814. Openings 904, 906, 908, 910, 912 and 914 are sized such that a fastening mechanism for product post 122 can pass through openings 904, 906, 908, 910, 912 or 914 thereby allowing product posts such as product post 122 to be slid within openings 814, 816 and 818 from side 801 to side 802 without interference from brackets 820 and 822. In particular, product post 122 can be slid without fully disassembling the fastening mechanism from the product post but instead loosening the fastening mechanism and then sliding product post 122 along the opening. This simplifies positioning of product post 122 on retail fixture 100.

Figure 10:
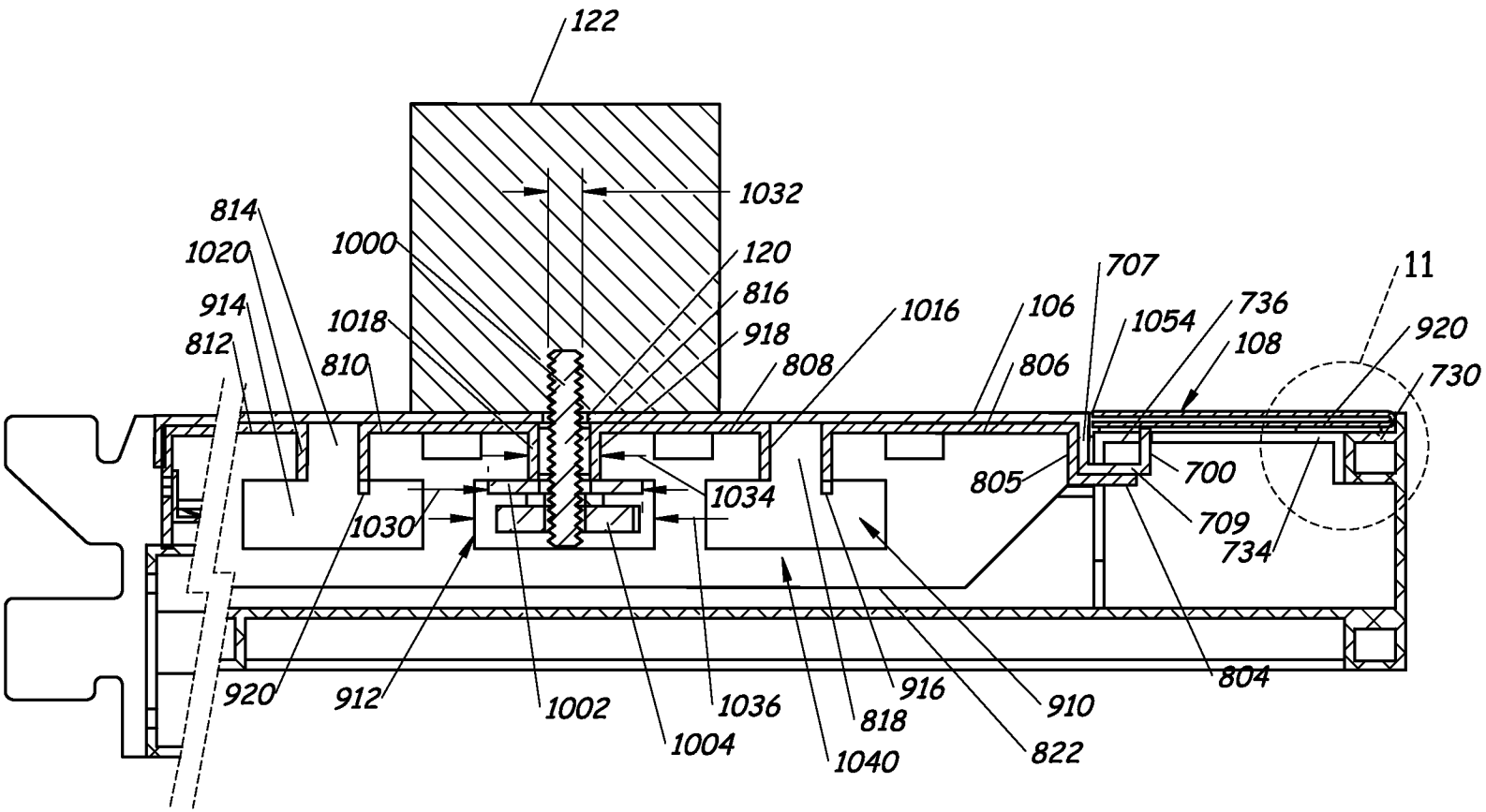
FIG. 10 provides a sectional view of the retail fixture of FIG. 1.
Figure 11:
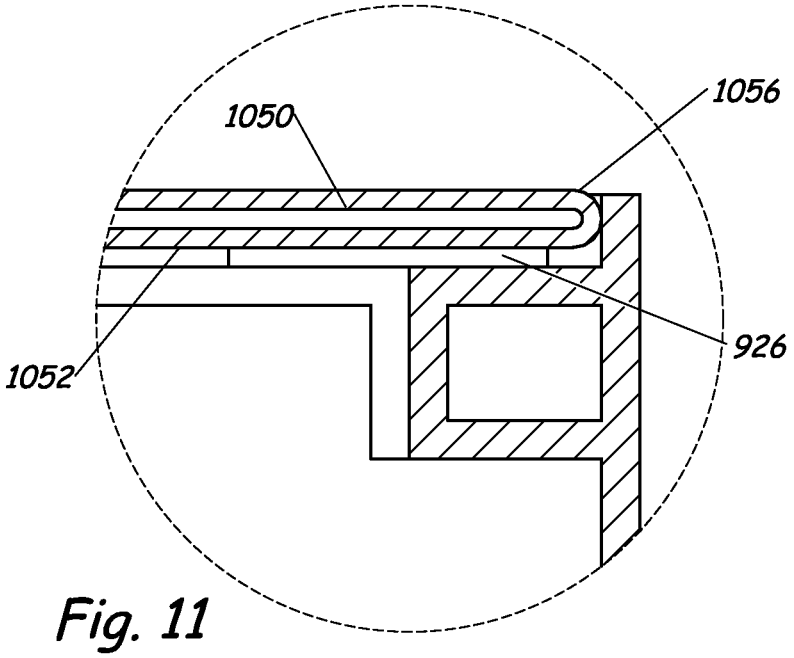
FIG. 11 provides an enlarged view of a portion of the sectional view of FIG. 10.

FIG. 10 provides a sectional view of retail fixture 100 along the line indicated in FIG. 1 and shows the relative sizing of the fastening mechanism and opening 912. As shown in FIG. 10, cover 106 overlays platform 712 such that slot 120 is aligned with opening 816. Cover 106 covers openings 814 and 818. Front 805 of lateral member 806 is shown to be covered by front 707 of cover 106 and forward projecting element 804 is shown to be covered by lateral extension 709 of cover 106.

Vertical extension 700 of cover 106 contacts a bottom panel 1052 of label holder 108, which is also supported by label holder support structures 736, 734 and 730 of base 102. Label holder 108 also includes a top panel 1050 that is connected to bottom panel 1052 at a closed end 1056. Label holder 108 has at least one open end 1054 and may have as many as three open ends. Label holder 108 is made of a flexible clear plastic and one or more labels may be inserted into the open ends, such as open end 1054 of label holder 108. In accordance with one embodiment, when assembled, a top surface of top panel 1050 is in the same plane as the top surface of cover 106.

Support 822 is shown as being attached to a bottom surface of platform 712 and in particular is attached to the bottom surfaces of lateral members 806, 808, 810 and 812. Support structure 822 includes a bottom section 1040 that spans each of openings 814, 816 and 818. Channel 910 of support 822 has a first width or upper span proximate the bottom surface of platform 712 that spans opening 818, downwardly extending protrusion 916 of lateral member 806 and downwardly extending protrusion 1016 of lateral member 808. Channel 910 includes a second width or lower span distal from the bottom surface of platform 712 that is wider than the upper span. Similarly, channel 914 of support 822 includes a first width or upper span that spans downwardly extending protrusion 920 of lateral member 801, opening 814 and downwardly extending protrusion 1020 of lateral member 812. Channel 914 has a second width or lower span that is wider than the first width or upper span of channel 914. Similarly, channel 912 includes a first width or upper span 1034 that spans downwardly extending protrusion 918 of lateral member 808, opening 816 and downwardly extending protrusion 1018 of lateral member 810. Channel 912 also includes a second or lower span 1036 that is wider than upper span 1034.

Threaded bolt 1000 is a narrow portion of the fastening mechanism for product post 122 and has a width 1032 that is less than the width of slot 120 and opening 816 and thus fits within the upper span 1034 of channel 912. Plate 1002 is a wide portion of the fastening mechanism and has a width 1030 that is wider than upper span 1034 of channel 912 and that is wide enough to contact bottom surfaces of both downwardly extending protrusion 918 and downwardly extending protrusion 1018. Width 1030 of plate 1002 is less than lower span 1036 of channel 912. As a result, plate 1002 can move within channel 912. Similarly, nut 1004 of the fastening mechanism has a width that is less than lower span 1036 thereby allowing nut 1004 to also pass through channel 912. As a result, if nut 1004 is loosened but not removed from threaded bolt 1000, it is possible to slide post 122 along slots 120/816 such that plate 1002 and nut 1004 pass through channel 912 without interference from support 822.

Figure 12:
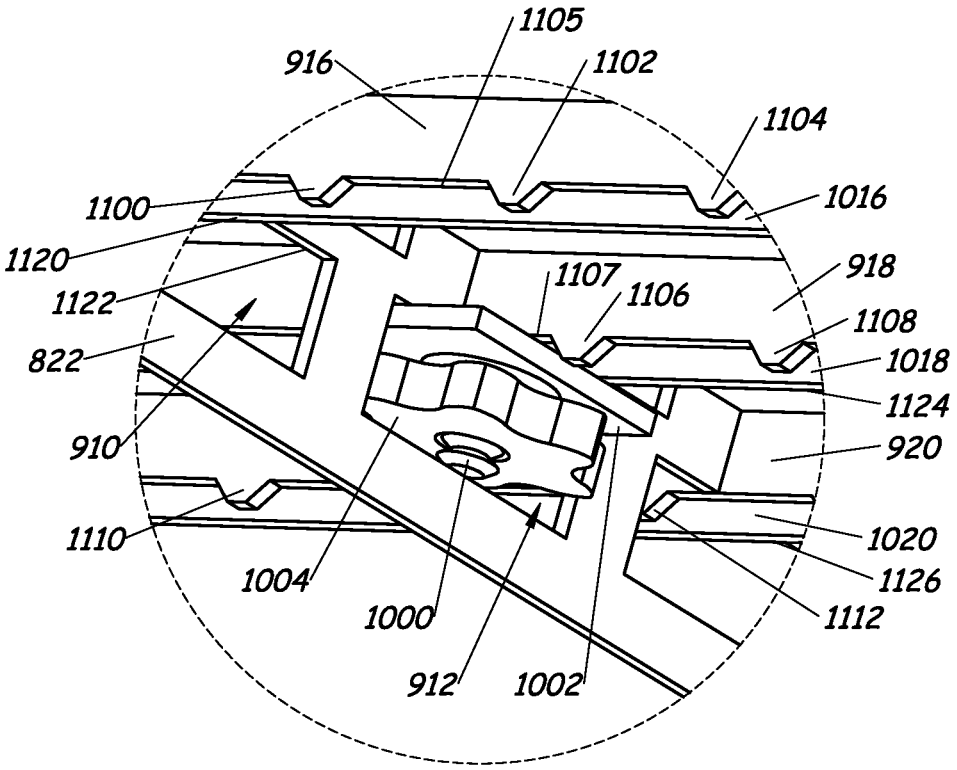
FIG. 12 provides a bottom perspective view of a portion of the retail fixture of FIG. 1.

FIG. 12 provides a bottom perspective view showing support structure 822 and the downwardly extending protrusions in more detail. In particular, downwardly extending protrusion 916 is shown to include spaced-apart nubs 1100, 1102 and 1104 that are space apart from each other by planar regions such as planar region 1105. Downwardly extending protrusion 1016 is shown to have a planar bottom surface 1120 that is coplanar with a bottom surface 1122 of support structure 822. Downwardly extending protrusion 920 is shown to include spaced-apart nubs 1110 and 1112 and downwardly extending protrusion 1020 is shown to have a planar bottom surface 1126. Downwardly extending protrusion 918 includes spaced-apart nubs or position keys 1106 and 1108. An additional nub on downwardly extending protrusion 918 is obscured by plate 1002 and nut 1004. Downwardly extending protrusion 1018 is shown to have a planar bottom surface 1124.

Nubs or position keys 1100, 1102, 1104, 1106, 1108, 1110 and 1112 define positions where a plate, such as plate 1002 may be positioned. For example, the planar surface 1105 defined by nubs 1100 and 1102 provides a mounting position where a plate may be located. Similarly, the obscured nub and nub 1106 define a mounting position 1107 where plate 1002 rests. Plate 1002 also rests on planar surface 1124 of downwardly extending protrusion 1018 and the bottom surface of support 822 within channel 912.

Although downwardly extending protrusions 1018, 1020 and 1022 are shown to have planar bottom surfaces, in accordance with some embodiments, downwardly extending protrusions 1018, 1020 and 1022 may also have a set or series of spaced-apart nubs or position keys that define where a mounting plate can be positioned.

Product post 122 is designed to support a product such as a camera, tablet computer, cell phone, or shaver, for example, in a raised position relative to cover 106. In accordance with some embodiments, a product is fastened to a top or side of product post 122 and may receive power through the product post or through a separate conductor. Product post 122 is shown as a rectangular block but in other embodiments product post 122 has other shapes. Although a single product post is shown, multiple product posts can be mounted within each slot of cover 106.

FIG. 7 shows retail fixture 100 in a raised positioned with label holder 108 removed. Platform 712 of retail fixture 100 is raised by a raising member or linkage 702 and a raising member or linkage 722 (FIGS. 8 and 9) so that platform 712 is separated from base 102 by a distance 706. Linkages 702 and 722 are respectively fastened to end pieces 801 and 802 (FIGS. 8 and 9) of platform 712 and are respectively fastened to side support members 152 and 150 of base 102.

Figure 13:
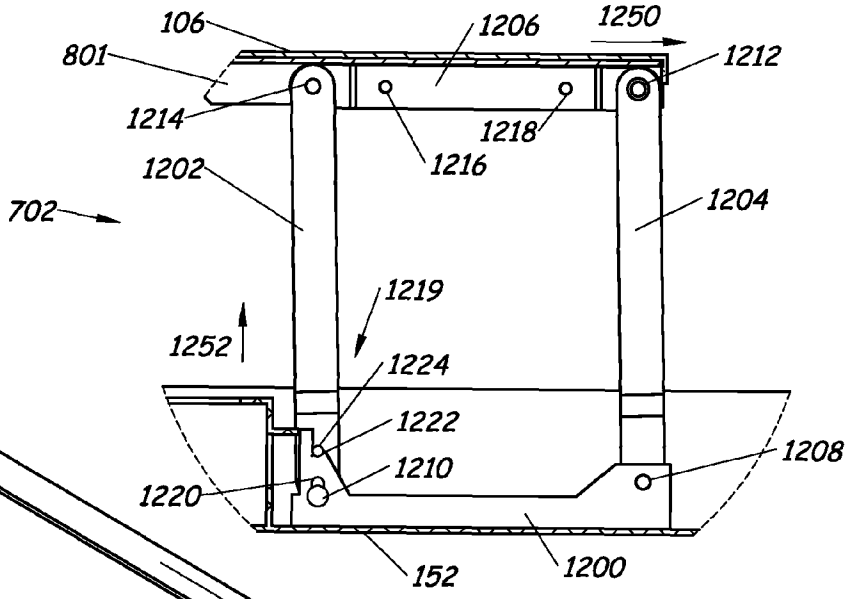
FIG. 13 provides a side view of a linkage in a raised position.

FIG. 13 provides a side view of linkage 702 in a raised position when attached to end 801 of platform 712 and mounting member 152 of base 102. Linkage 702 includes base member 1200, substantially rigid members 1202 and 1204 and upper member 1206. Base member 1200 is connected to substantially rigid member 1202 at a pivot point 1210 and to substantially rigid member 1204 at a pivot point 1208. Upper member 1206 is attached to substantially rigid member 1202 at a pivot point 1214 and to substantially rigid member 1204 at a point 1212. Upper member 1206 is mounted to end 801 by fasteners 1216 and 1218. Base member 1200 is mounted to mounting member 152 by fasteners that are not shown.

Linkage 702 includes a locking mechanism 1219 formed of a catch 1222 and a pin 1224. Catch 1222 consists of a recess into which pin 1224 drops as platform 712 is brought into the raised position. When pin 1224 falls into the recess of catch 1222, linkage 702 cannot be moved in a direction 1250 without first lifting the front of platform 712 in a direction 1252 so that pivot pin 1210 moves upward in slot 1220 and pin 1224 moves out of catch 1222. Platform 712 may be then be pushed in direction 1250 causing linkage 702 to collapse downward. Although linkage 702 has been discussed in FIG. 12, linkage 722 operates in a similar fashion. By requiring that platform 712 be lifted before allowing linkage 702 to collapse, locking mechanism 1219 of linkage 702 helps to prevent platform 712 from closing unexpectedly.

Figure 14:
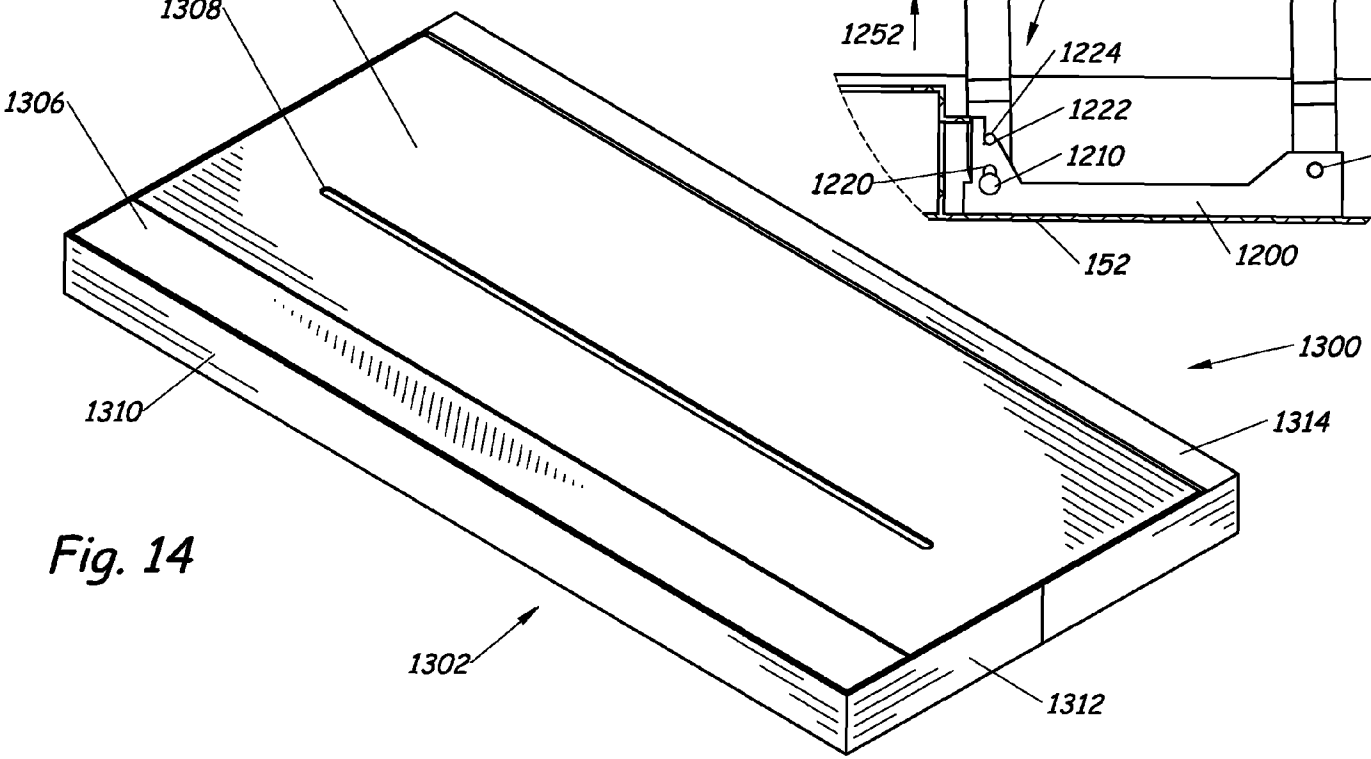
FIG. 14 provides a perspective view of second embodiment of a retail fixture.
Figure 15:
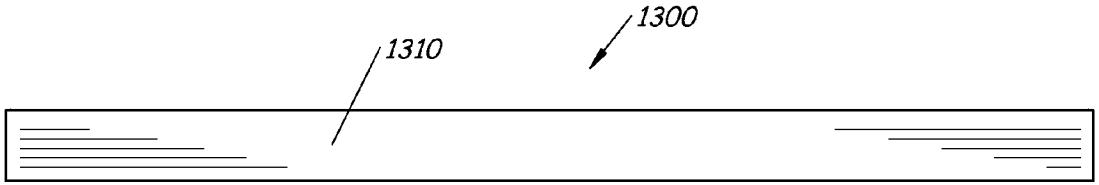
FIG. 15 provides a front view of the retail fixture of FIG. 14.
Figure 16:
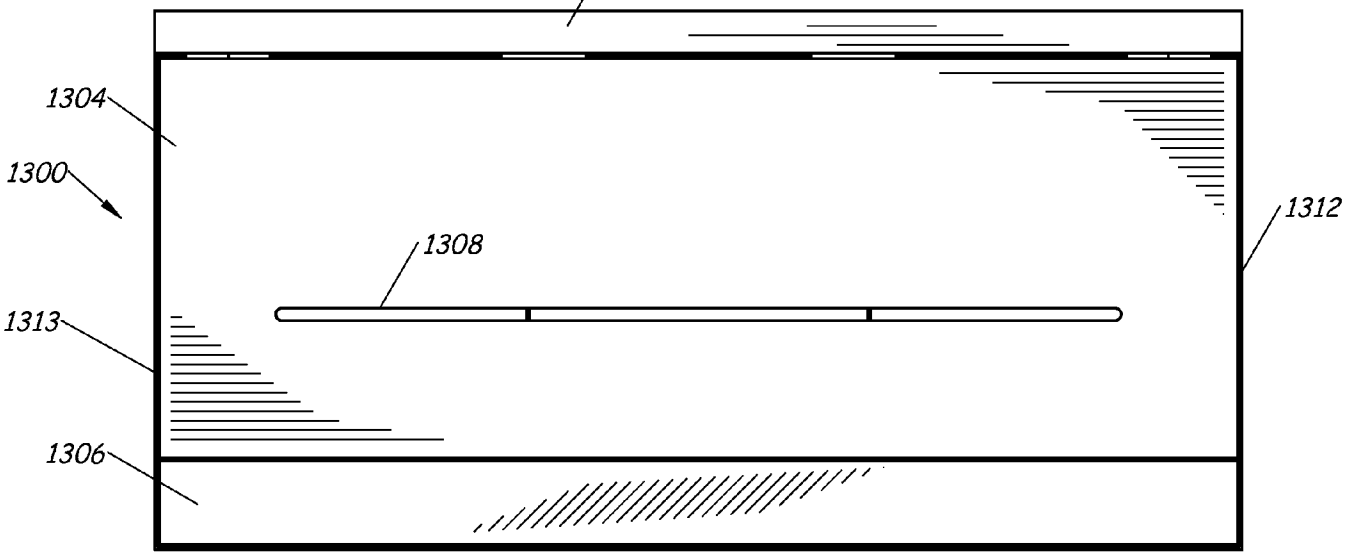
FIG. 16 provides a top view of the retail fixture of FIG. 14.
Figure 17:
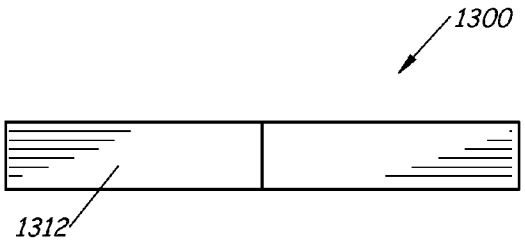
FIG. 17 provides a right side view of the retail fixture of FIG. 14.
Figure 18:
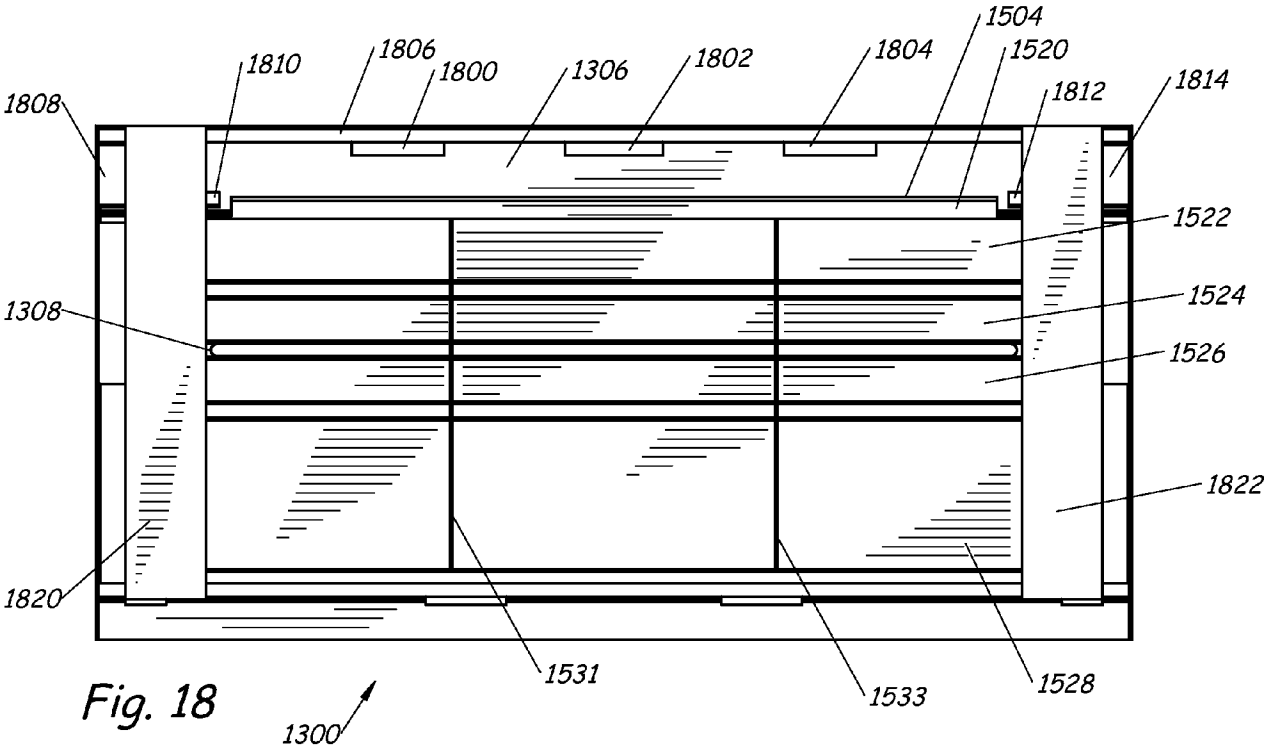
FIG. 18 provides a bottom view of the retail fixture of FIG. 14
Figure 19:
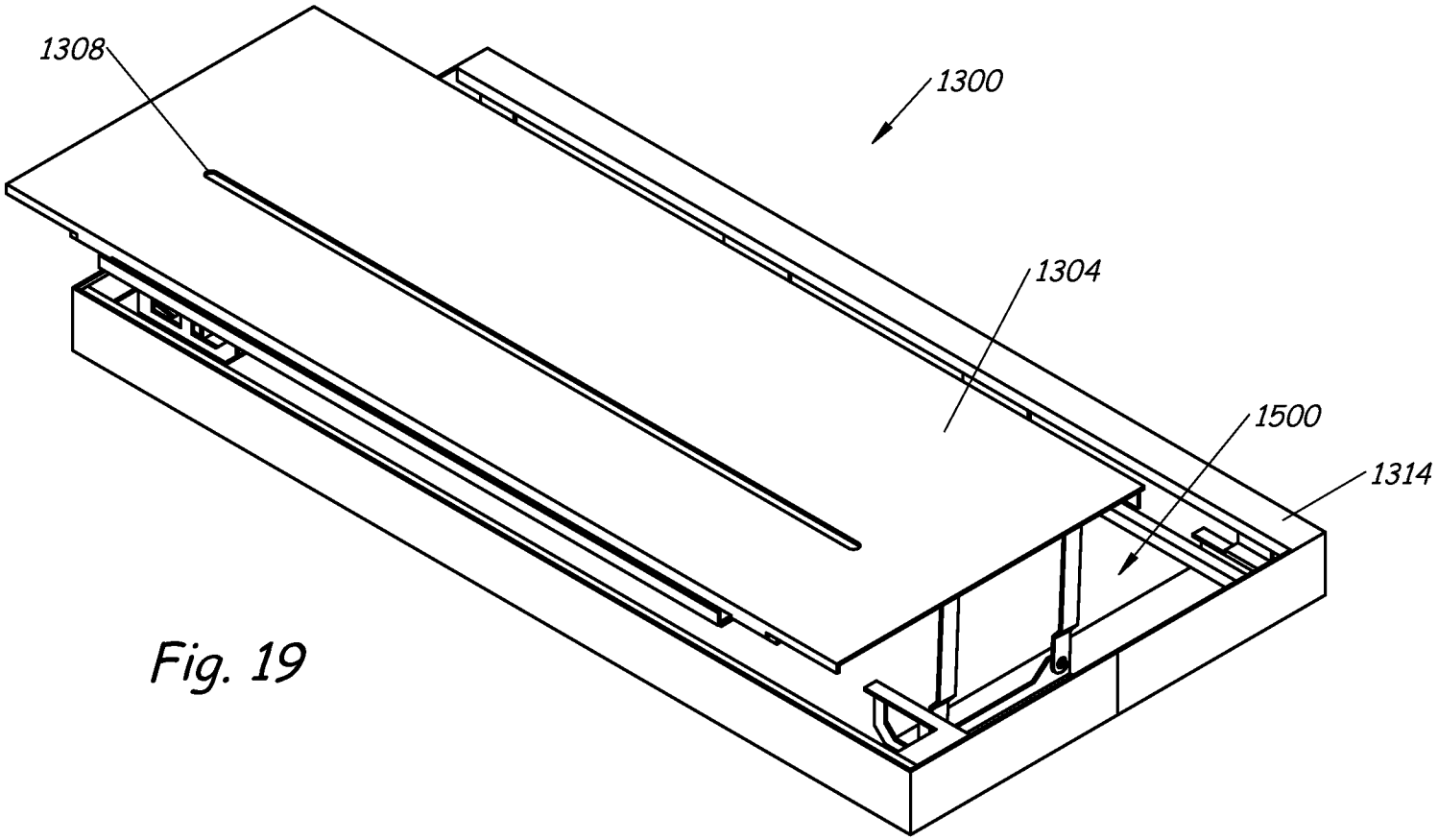
FIG. 19 provides a perspective view of the retail fixture of FIG. 14 with its platform in a raised position.
Figure 20:
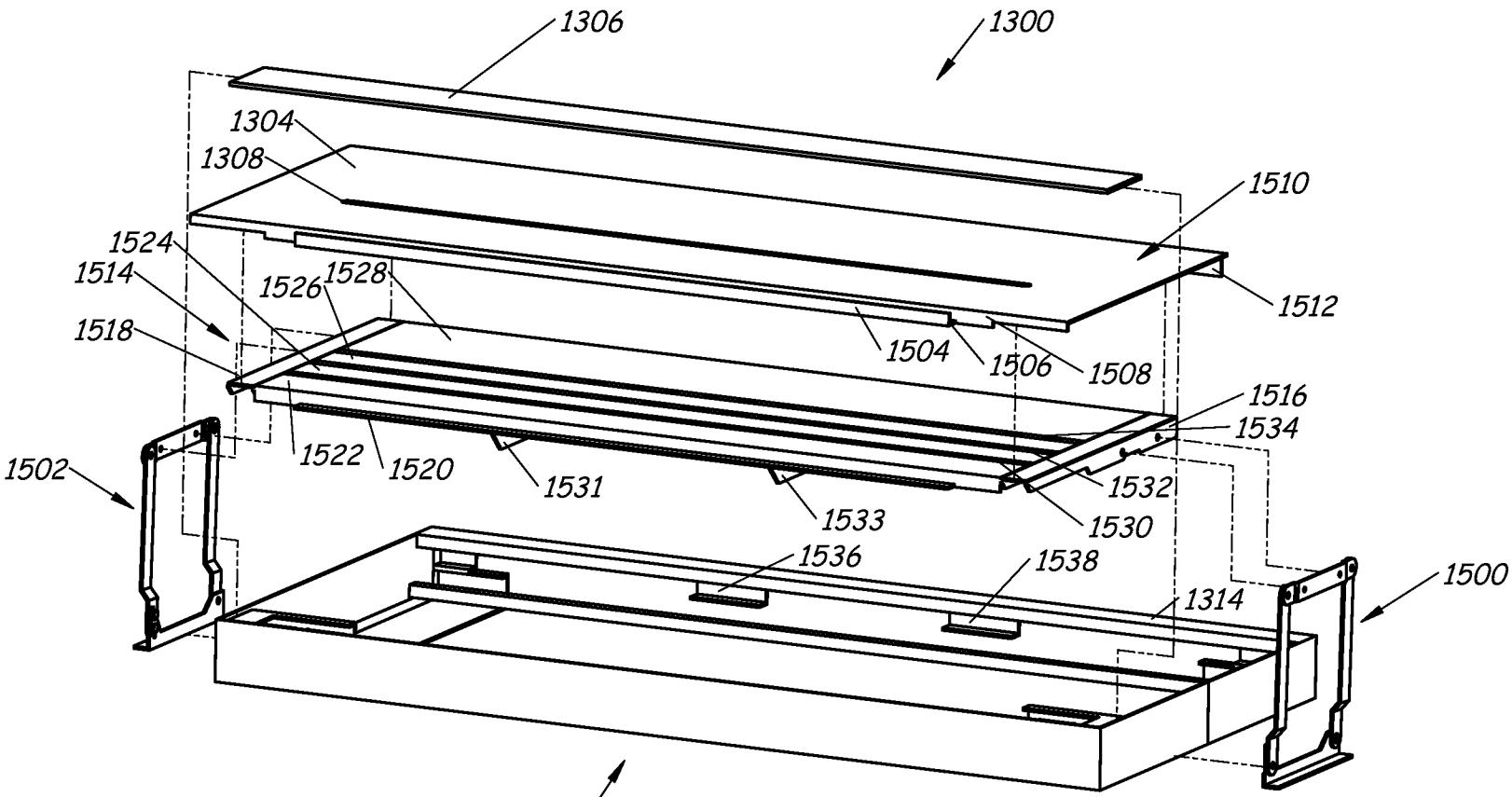
FIG. 20 provides a top perspective exploded view of the retail fixture of FIG. 14.

FIG. 14 provides a perspective view of a second embodiment of a retail fixture/product support/retail display structure 1300. FIGS. 15, 16, 17, and 18 provide a front view, a top view, a right side view and a bottom view of retail fixture 1300. The left side view is the mirror image of the right side view illustrated in FIG. 17. FIG. 19 provides a perspective view of retail fixture 1300 in a raised position. FIG. 20 provides a top perspective exploded view of retail fixture 1300.

Retail fixture 1300 includes a base 1302, a cover or overlay 1304, a platform 1514, two linkages 1500 and 1502, and a label holder 1306 and is designed to be mounted on the top of a table, counter, or other flat surface.

Base 1302 includes a front 1310, a right side 1312, a left side 1313, a back 1314, and two side support members 1820 and 1822. In accordance with one embodiment, retail fixture 1300 is mounted to a table, counter or other flat surface by fastening support members 1820 and 1822 to the surface. Back 1314 includes openings 1536 and 1538 through which one or more cords may be passed to provide power or data to products displayed on retail fixture 1300. Base 1302 also includes label support structures 1808, 1810, 1812, 1814 and 1816 (FIG. 18). These label support structures support a portion of label holder 1306. Magnets 1800, 1802 and 1804 are adhered to the bottom label holder 1306 to provide a releasable connection between label holder 1306 and base 1302.

As shown most clearly in FIG. 20, cover 1304 includes a top surface 1510 with a slot 1308, a back surface 1512, front surface 1508, a lateral extension 1506 and a vertical extension 1504. In the closed or lower position, lateral extension 1506 and vertical extension 1504 together form a label support structure or sign support structure that supports a portion of label holder 1306. Although cover 1304 shows a single slot 1308, which is aligned with opening 1532 of platform 1514, other covers may be used that have different numbers of slots, different sized slots, or different combinations of slots. In addition, although slot 1308 is shown as an elongated slot, in other embodiments slot 1308 has other shapes such as a round hole, for example. Further, although only a single slot is shown aligned with opening 1532, in other embodiments multiple separate slots are aligned with opening 1532 with each slot having a same shape as the other slots aligned with opening 1532 or with one or more of the slots having different shapes. Other examples of possible covers are discussed further below in connection with FIGS. 29-37. Thus, by replacing cover 1304, it is possible to change the number of slots and the position of those slots on retail fixture 1300.

Cover 1304 may be constructed of metal, plastic or wood or other fibrous material. Cover 1304 may have a same color and finish as platform 1514 and base 1302 or may have a different appearance. For example, in accordance with some embodiments, cover 1304 appears to have a wood grain or is actually constructed from wood while the remainder of retail fixture 1300 is constructed of metal.

Platform 1514 has an identical structure to platform 712 described above and includes a first end 1516, second end 1518 and lateral members 1522, 1524, 1526 and 1528, which together define openings 1530, 1532 and 1534 that extend from end 1516 to end 1518. Platform 1514 also includes supports 1531 and 1533 that traverse openings 1530, 1532 and 1534. Supports 1531 and 1533 have identical structures to support 822 described above. Platform 1514 also includes forward projecting element 1520.

Linkages 1500 and 1502 are mounted on mounting members 1822 and 1820, respectively, of base 1302. Further, linkages 1500 and 1502 are attached to ends 1516 and 1518 of platform 1514. Linkages 1500 and 1502 have the same structure and operate in the same manner as linkage 702 of FIG. 12.

Figure 21:
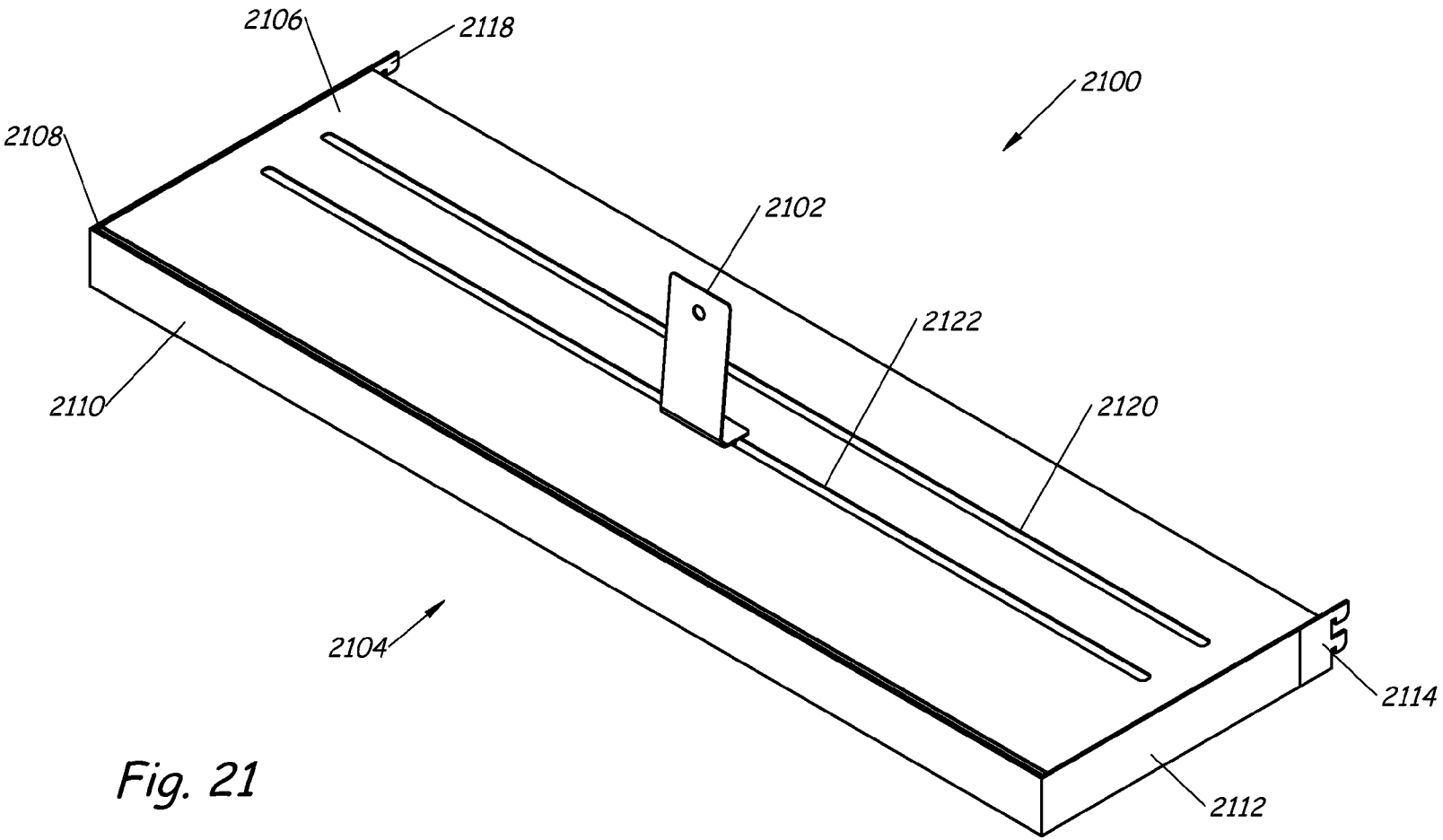
FIG. 21 provides a perspective view of a third embodiment of a retail fixture with a product support.
Figure 22A:
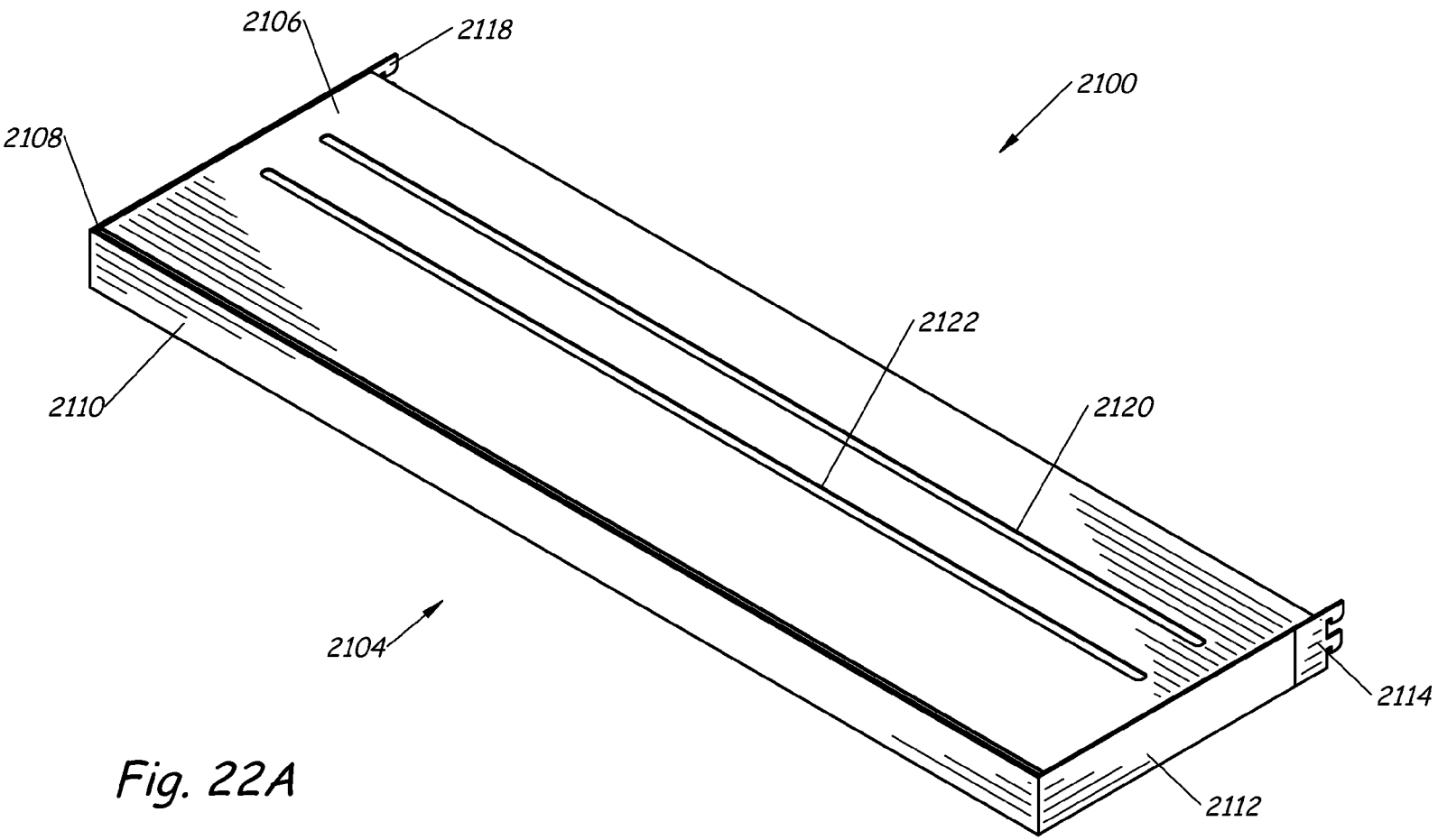
FIG. 22A provides a perspective view of the retail fixture of FIG. 21 without the product support.
Figure 22B:
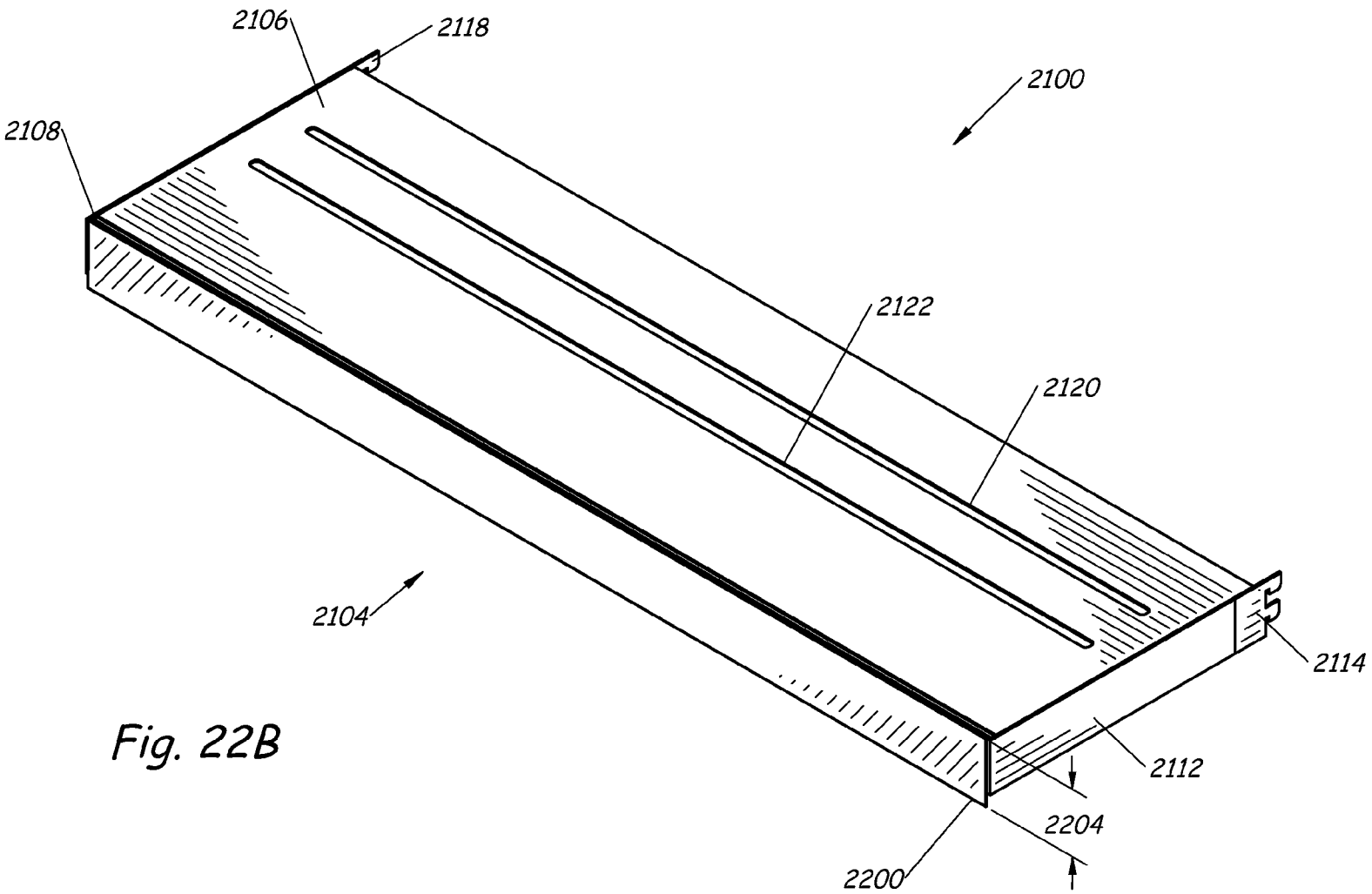
FIG. 22B provides a perspective view of the retail fixture of FIG. 21 without the product support and with a front-facing label strip.
Figure 22C:
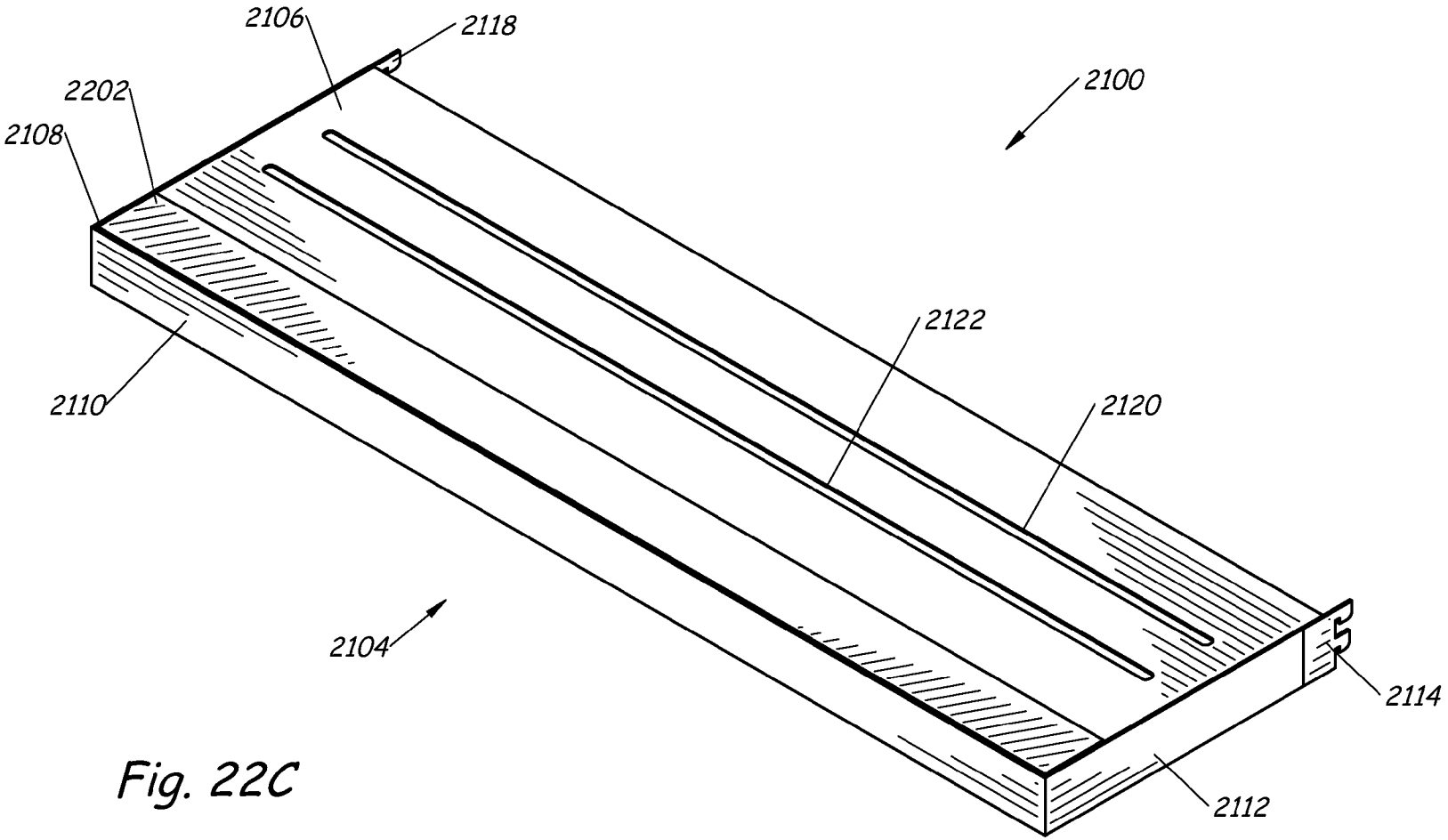
FIG. 22C provides a perspective view of the retail fixture of FIG. 21 without the product support and with a top-facing label strip.
Figure 23:
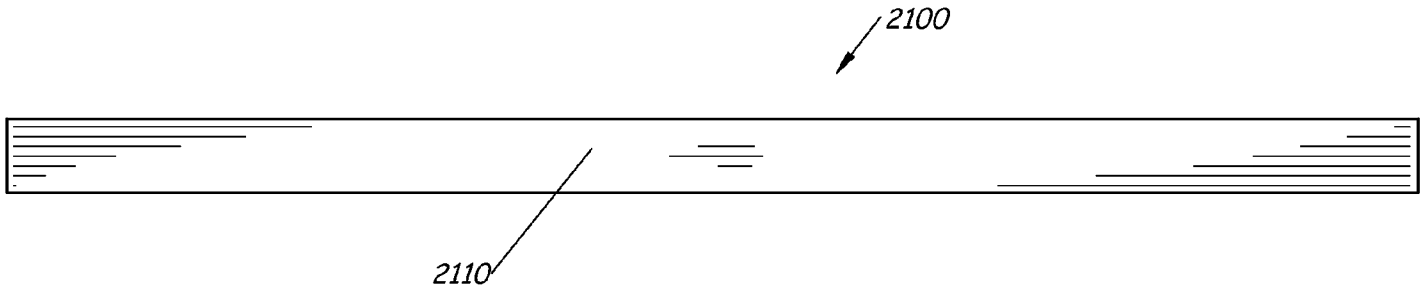
FIG. 23 provides a front view of the retail fixture of FIG. 22A.
Figure 24:
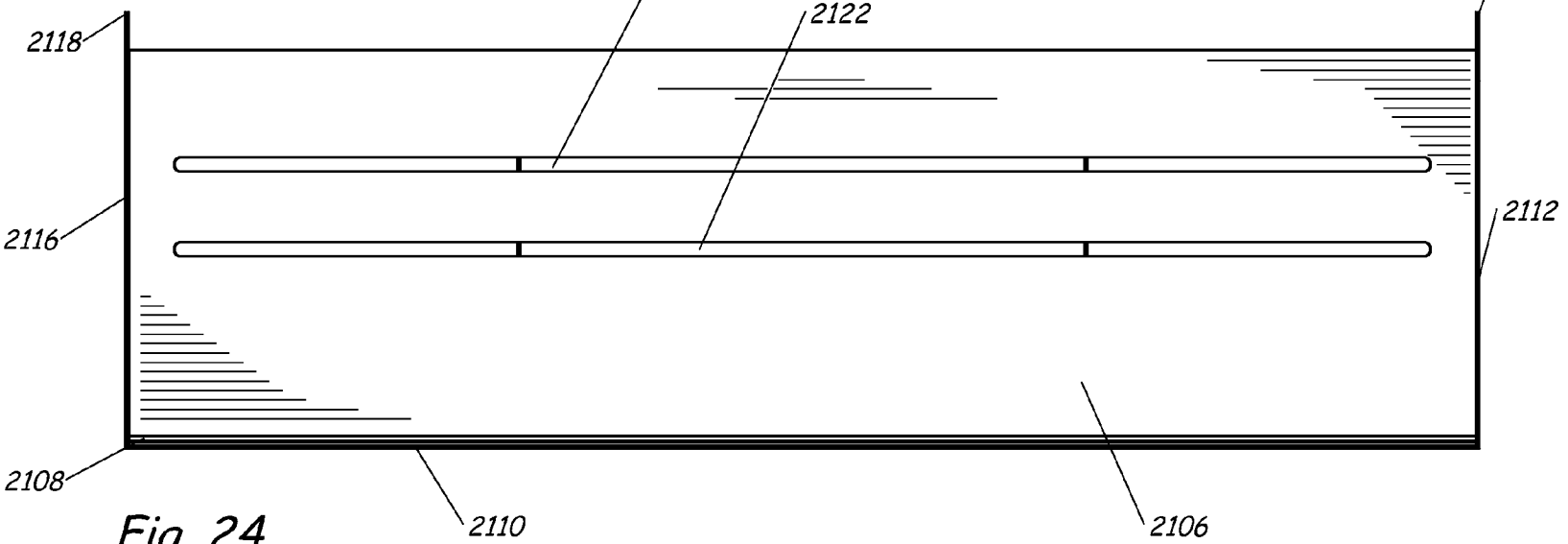
FIG. 24 provides a top view of the retail fixture of FIG. 22A.
Figure 25:
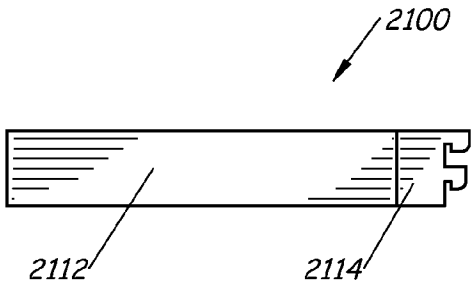
FIG. 25 provides a right side view of the retail fixture of FIG. 22A.
Figure 26:
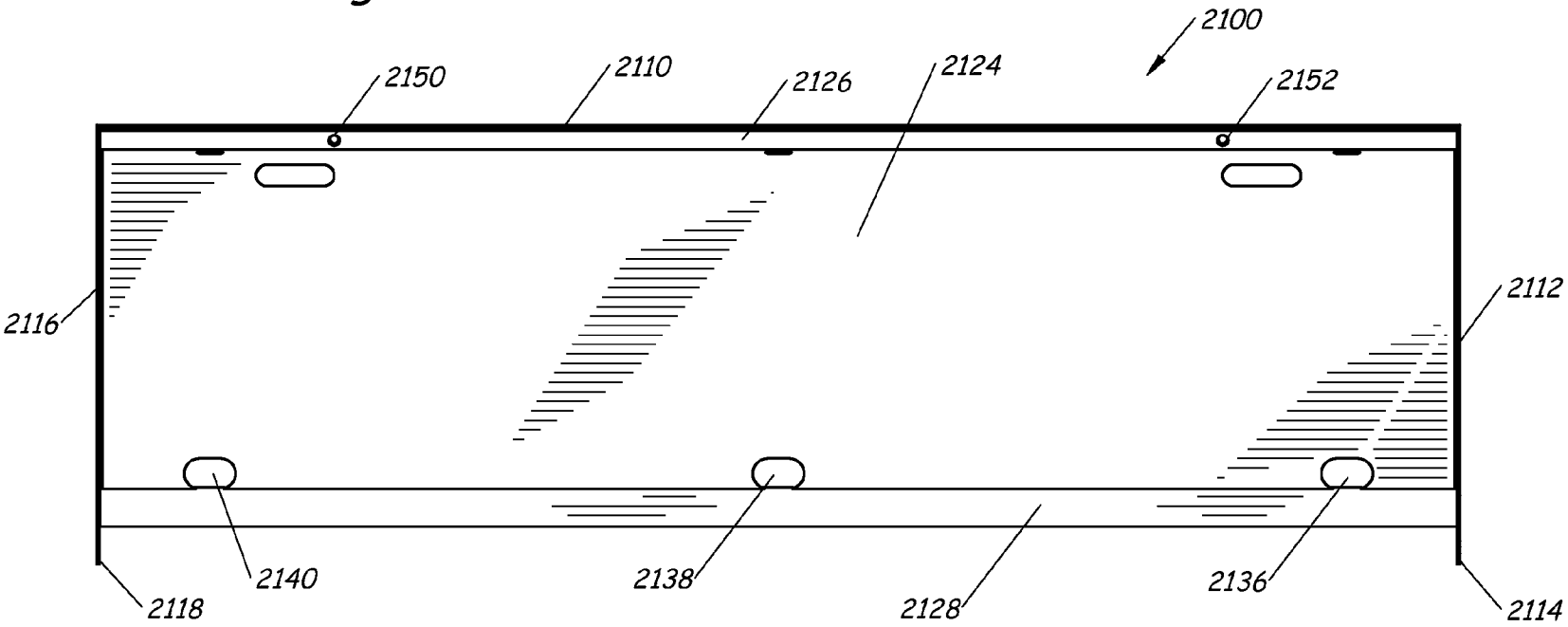
FIG. 26 provides a bottom view of the retail fixture of FIG. 22A.
Figure 27:
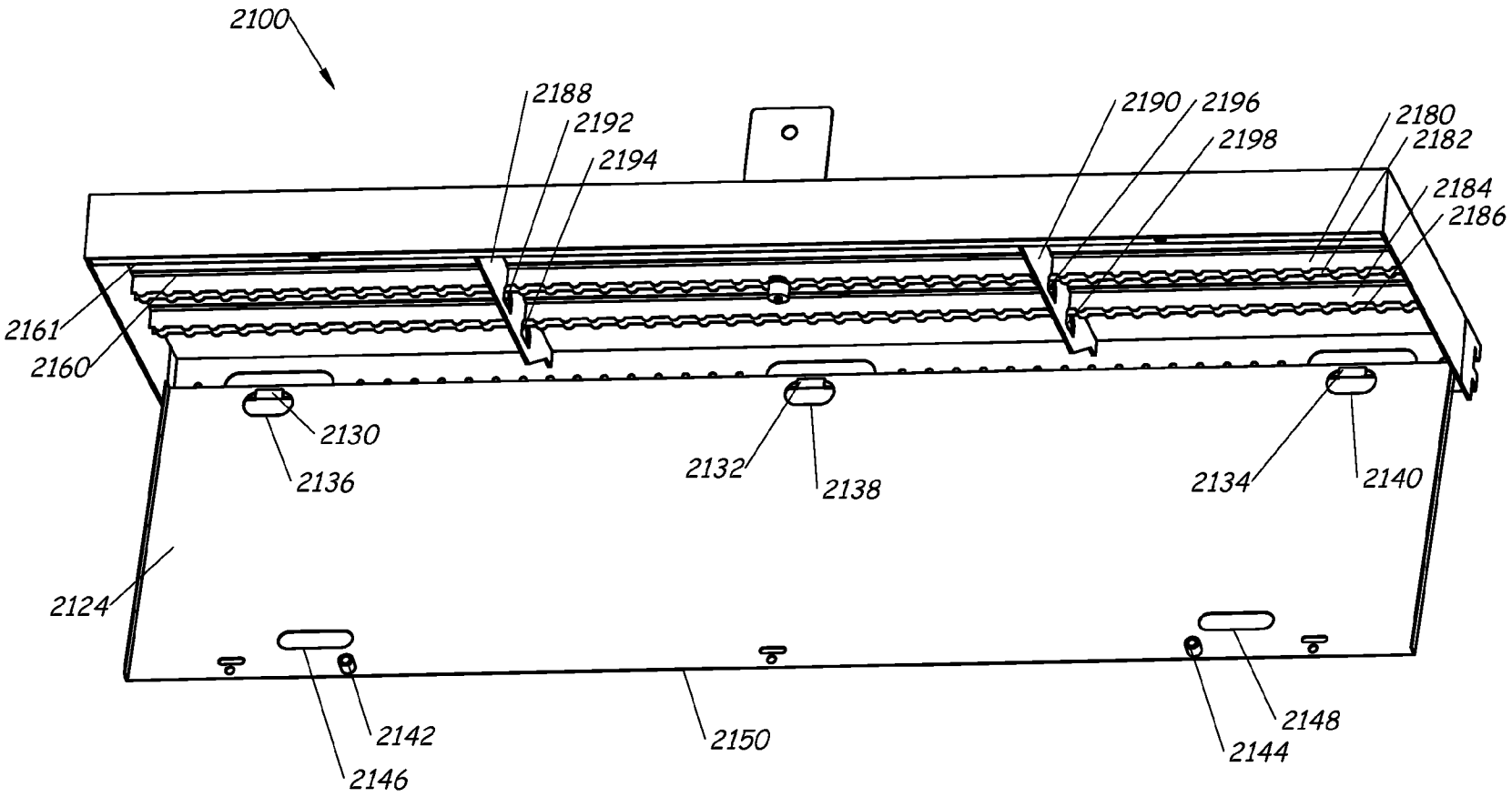
FIG. 27 provides a bottom respective view of the retail fixture of FIG. 22A with a bottom cover in an open position.
Figure 28:
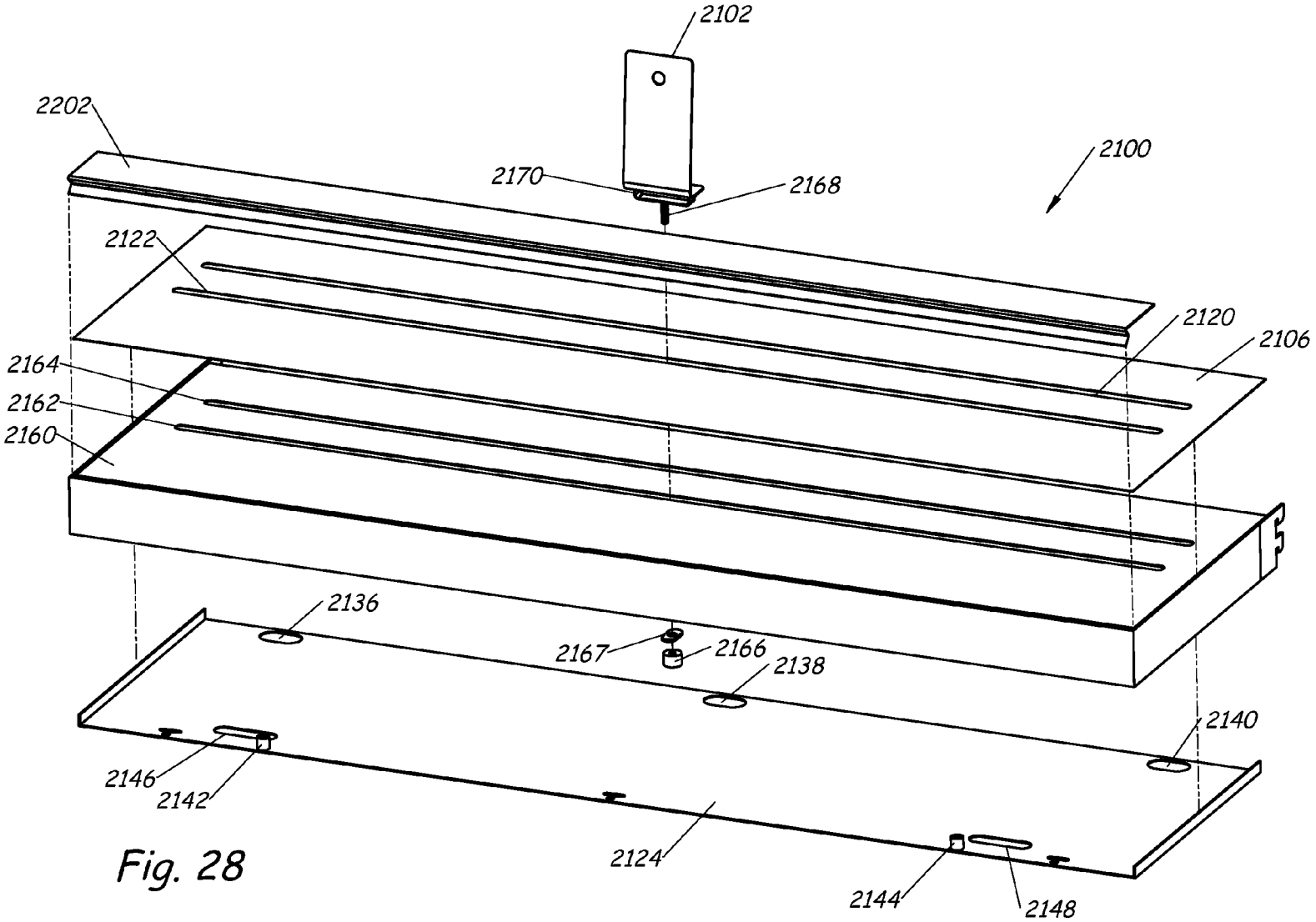
FIG. 28 provides a top exploded perspective view of the retail fixture of FIG. 21 with a top-facing label strip.

FIG. 21 provides a perspective view of a third embodiment showing a retail fixture/product support/retail display structure 2100 with a product holder 2102. FIG. 22A provides a perspective view of retail fixture 2100 without product holder 2102. FIG. 22B provides a perspective view of retail fixture 2100 without product holder 2102 but with a forward-facing label strip 2200. FIG. 22C provides a perspective view of retail fixture 2100 without product holder 2102 but with a top-facing label strip 2202. FIGS. 23, 24, 25 and 26 provide a front view, a top view, a right side view and a bottom view, respectively, of retail fixture 2100 of FIG. 22A. The left side view is the mirror image of the right side view illustrated in FIG. 25. FIG. 27 provides a bottom respective view of retail fixture 2100 with a bottom cover in an open position and FIG. 28 provides a top exploded perspective view of retail fixture 2100 of FIG. 21 with a top-facing label holder 2202.

Retail fixture 2100 includes a base 2104, a cover or overlay 2106, a platform 2160 (FIGS. 27 and 28), and a bottom removable cover 2124. Base 2104 includes a front 2110 having a height 2204 (FIG. 22B), a first side 2112 with a mounting bracket 2114, a second side 2116 with a mounting bracket 2118 (FIG. 24), and a back frame member 2128 (FIG. 26 and FIG. 27). Mounting brackets 2114 and 2118 are shaped to be mounted to and lock into uprights of retail display structures so that retail fixture 2100 appears as a shelf. Platform 2160 is welded to sides 2112 and 2116 and spaced behind front 2110 to form a label slot 2108 into which portions of a label strip or label holder may be inserted as shown in FIGS. 22B and 22C. The label strip or label holder may be a forward-facing label strip 2200 as shown in FIG. 22B or a top-facing label strip 2202 as shown in FIG. 22C. Forward-facing label strip 2200 includes a channel to receive one or more labels such as price labels or information labels, for example. In FIG. 22C, a space is provided between top-facing label strip 2202 and cover 2106 to receive one or more labels such as price labels or information labels, for example.

Cover 2106 overlays platform 2160 and includes one or more slots such as slots 2120 and 2122. Platform 2160 includes openings 2164 and 2162. When cover 2106 is overlaid on platform 2160, slot 2120 is aligned with opening 2164 and slot 2122 is aligned with opening 2162. Although cover 2106 is shown to have the same number of slots as openings in platform 2160, in other embodiments, cover 2106 has fewer slots than the openings in platform 2160. In addition, cover 2106 may be replaced with other covers having a different number of slots. In addition, although only two openings are shown in platform 2160, those skilled in the art will recognize that more openings may be provided in platform 2160. Although slots 2120 and 2122 are shown as elongated slots, in other embodiments, slots 2120 and 2122 have other shapes such as a round hole, for example. Further, although only a single slot is shown aligned with each opening 2162 and 2164, in other embodiments, multiple separate slots are aligned with each opening with each slot having a same shape as the other slots aligned with the opening or with one or more of the slots having different shapes.

Cover 2106 may be constructed of metal, plastic or wood or other fibrous material. Cover 2106 may have a same color and finish as platform 2160 and base 2104 or may have a different appearance. For example, in accordance with some embodiments, cover 2106 appears to have a wood grain or is actually constructed from wood while the remainder of retail fixture 2100 is constructed of metal.

Product holder 2102 is fastened to retail fixture 2100 by inserting a post 2168 through a slot in cover 2106 and a corresponding opening in platform 2160. A plate 2167 is fastened to post 2168 and a fastening nut 2166 is tightened on post 2168 to secure product holder 2102 to retail fixture 2100. In accordance with some embodiments, post 2168 is a threaded post and fastening nut 2166 is a threaded nut. To provide increased stability, product holder 2102 includes downwardly extending member 2170 that fits within the slots of cover 2106 and the openings of platform 2160.

Product holder 2102 is designed to support a product such as a camera, tablet computer, cell phone, or shaver, for example, in a raised position relative to cover 2106. In accordance with some embodiments, a product is fastened to a top or side of product holder 2102 and may receive power through the product holder or through a separate conductor. Product holder 2102 is shown as rectangular bracket but in other embodiments, product holder 2102 has other shapes. Although a single product holder is shown, multiple product holders can be mounted within each slot of cover 2106.

As shown in FIG. 27, along each opening 2162 and 2164, downwardly extending protrusions 2180, 2182, 2184 and 2186 are provided that each includes a set or series of spaced-apart nubs or positioning keys used to position the product holder 2102. In particular, plates, such as plate 2167 are positioned between the positioning keys along planar portions of the downwardly extending protrusions when securing product holder 2102 to platform 2160. In accordance with some embodiments, downwardly extending protrusions 2180, 2182, 2184 and 2186 are welded to a bottom surface 2161 of platform 2160. In FIG. 27, downwardly extending protrusions 2180 and 2182 are on opposite sides of opening 2162 and downwardly extending protrusions 2184 and 2186 are on opposing sides of opening 2164.

Retail fixture 2100 also includes two supports 2188 and 2190 that traverse openings 2162 and 2164. Channels or openings 2192 and 2194 in support 2188 and channels or openings 2196 and 2198 in support 2190 are shaped and sized to permit fastening mechanisms such as plate 2167 and fastening nut 2166 to pass through the openings without interference. This allows product holder 2102 to be shifted within openings 2162 and 2164 when fastening nut 2166 is loosened but not removed.

Bottom cover 2124 includes openings 2136, 2138 and 2140 that accept upwardly extending tabs 2130, 2132 and 2134 of back frame member 2128. As shown in FIG. 27, bottom cover 2124 can hang from tabs 2130, 2132 and 2134. In this position, it is possible to attach fastening nuts and plates to posts from various product holders to thereby secure the product stands to retail fixture 2100.

Bottom cover 2124 can be rotated upward such that a front edge 2150 can be placed above a ledge 2126 that extends back from front 2110. Bottom cover 2124 can then be shifted forward so that ledge 2126 supports bottom cover 2124 and bottom cover 2124 is secured to base 2104 by passing bolts through openings 2150 and 2152 in ledge 2126 and into securing nuts 2144 and 2142, which are permanently attached to bottom cover 2124.

Figure 29:
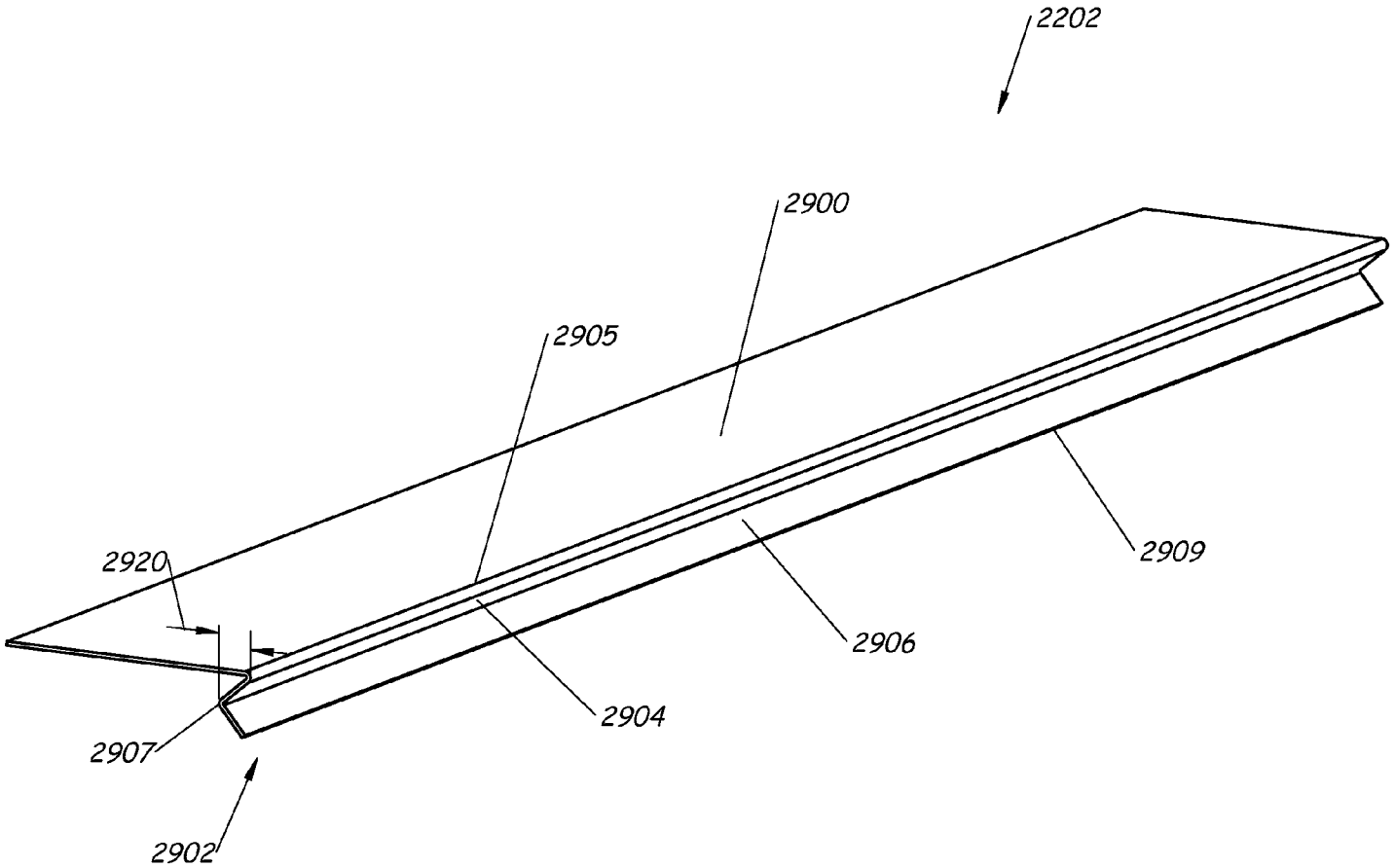
FIG. 29 provides a back perspective view of the label strip of FIGS. 22C and 28.

FIG. 29 provides a back perspective view of top-facing label strip 2202 of FIG. 22C. Top-facing label strip 2202 includes a top member 2900 and a securing tab 2902. Securing tab 2902 is designed to fit within label slot 2108 and includes securing members 2904 and 2906. Securing member 2904 extends from top member 2900 at a fold 2905 such that an interior angle between top member 2900 and securing member 2904 is less than ninety degrees. Securing member 2906 extends from securing member 2904 at a fold 2907 such that an interior angle between securing member 2906 and securing member 2904 is less than one-hundred eighty degrees. A lateral distance 2920 between folds 2905 and 2907 is greater than a width of label slot 2108 such that as securing tab 2902 is inserted in label slot 2108, fold 2907 expands to reduce the lateral distance between fold 2905 and fold 2907. As a result, fold 2907 and end 2909 of securing member 2906 contact side walls of label slot 2108 and maintain top-facing label strip 2202 in label slot 2108. Top-facing label strip 2202 is constructed of a substantially transparent, substantially flexible plastic in accordance with some embodiments.

Figure 30:
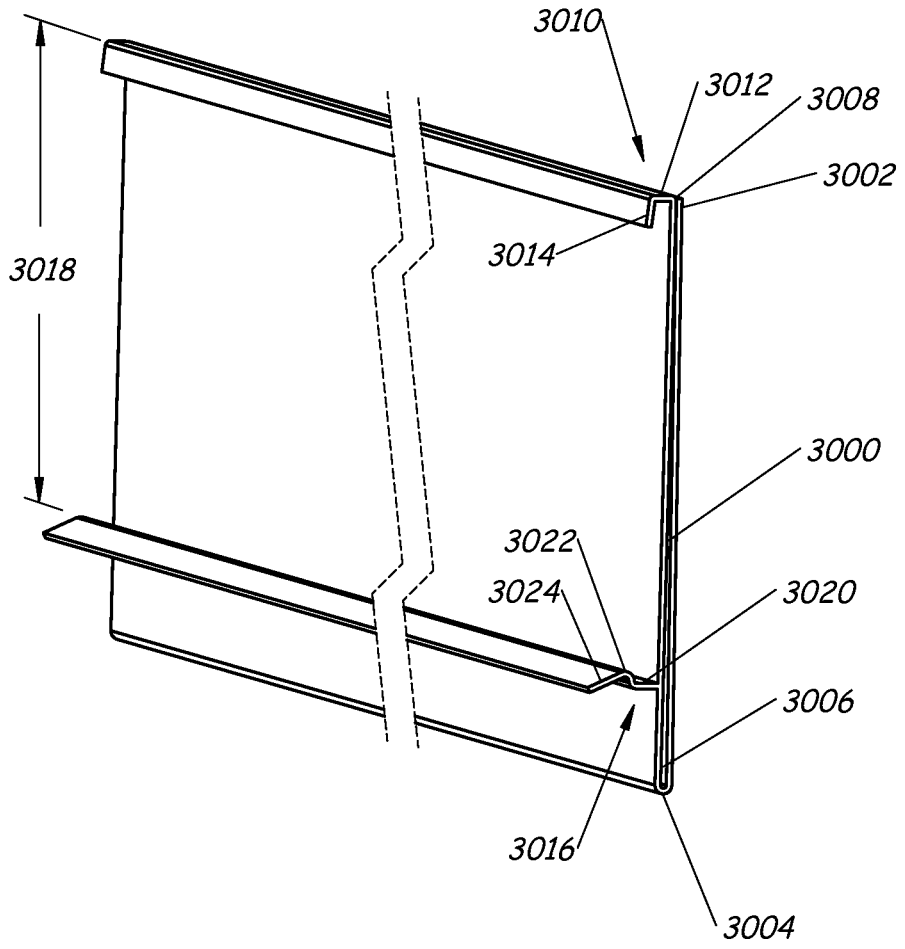
FIG. 30 provides a back perspective view of the label strip of FIG. 22B.

FIG. 30 provides a back perspective view of front-facing label strip 2200 of FIG. 22B. Front-facing label strip 2200 includes a front member 3002 attached to a back member 3000 at a closed bottom 3004 to form a channel 3006 with an open top 3008 between back member 3000 and front member 3002. Channel 3006 is provided to accept one or more labels. A hanger 3010 includes a backward extending top piece 3012 that extends backward from a top of back member 3000 and a downward extending back piece 3014 that extends from top piece 3012. Downward extending back piece is provided to be inserted in label slot 2108. A bottom securing tab 3016 extends backward from a position on back member 3000 that is a distance 3018 from top piece 3012. In accordance with one embodiment, distance 3018 is substantially similar to height 2204 of front 2110. Securing tab 3016 includes a substantially horizontal portion 3020, a ridge 3022 and an angled member 3024. To install front-facing label strip 2200, back piece 3014 of hanger 3010 is inserted into slot 2108 and the bottom of front-facing label strip 2200 is pressed toward front 2110. As front-facing label strip 2200 is pressed toward front 2110, a bottom edge of front 2110 presses against angled member 3024 causing securing tab 3016 to be deflected downward such that ridge 3022 moves below the bottom edge of front 2110. After ridge 3022 clears the bottom edge of front 2110, securing tab 3016 flexes back such that ridge 3022 secures front-facing label strip 2200 to front 2110. In accordance with some embodiments, front-facing label strip 2200 is constructed of a substantially transparent, substantially rigid PVC material.

FIGS. 31-37 provide examples of covers with various slot configurations that may be used as covers 106 and 1304 above. The slot configurations shown in FIGS. 31-37 may also be applied to cover 2106.

Figure 31:
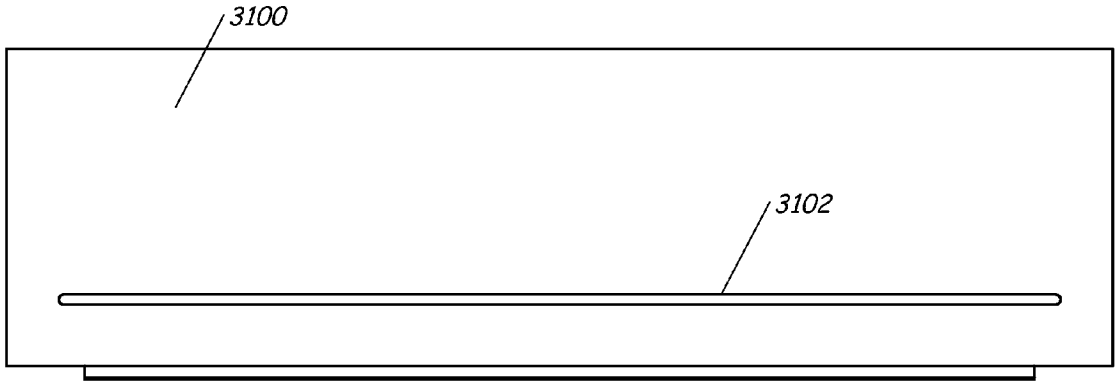
FIGS. 31-37 provide examples of covers with various slot configurations.
Figure 32:
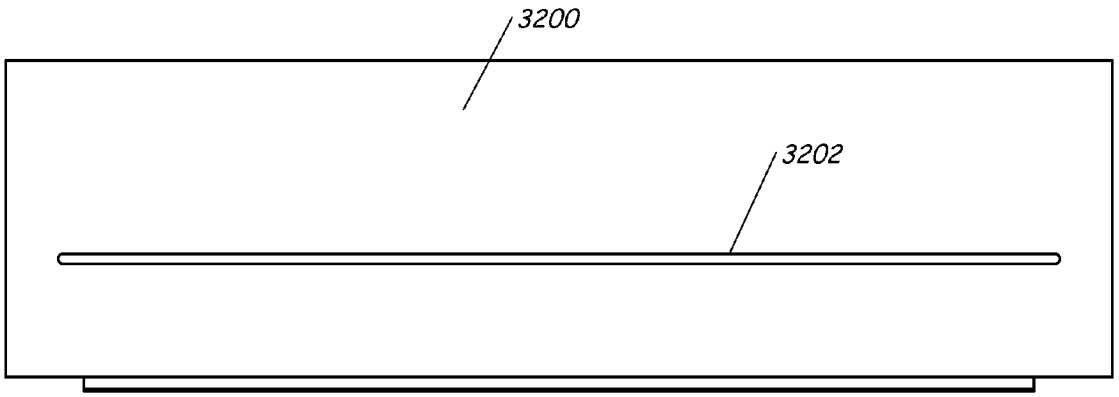
Figure 33:
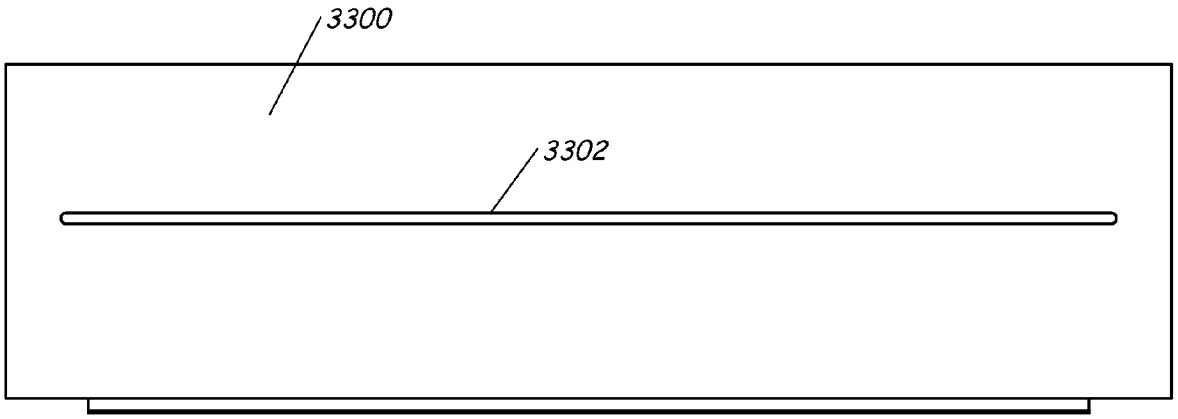

FIGS. 31, 32 and 33 provide covers 3100, 3200 and 3300, respectively. Each of these covers includes a single respective slot 3102, 3202, 3302. In cover 3100, slot 3102 is positioned to be aligned with the front-most opening in the underlying platform; in cover 3200, slot 3202 is positioned to be aligned with a middle opening in the underlying platform; and in cover 3300, slot 3302 is positioned to be aligned with the back-most opening in the platform.

Figure 34:
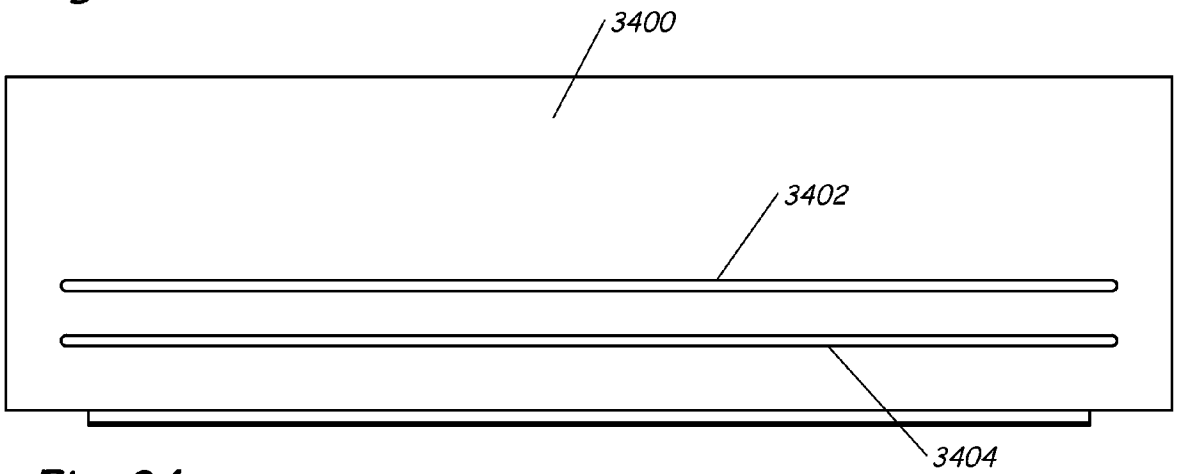
Figure 35:
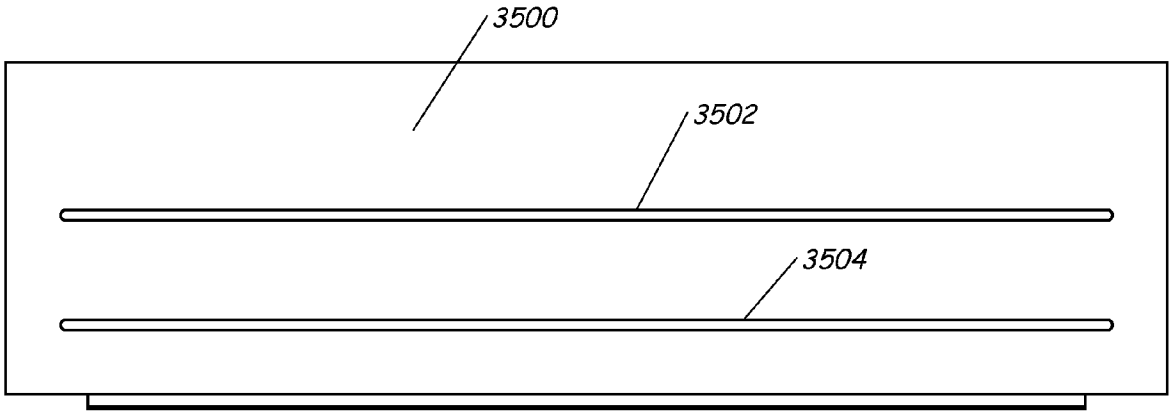
Figure 36:
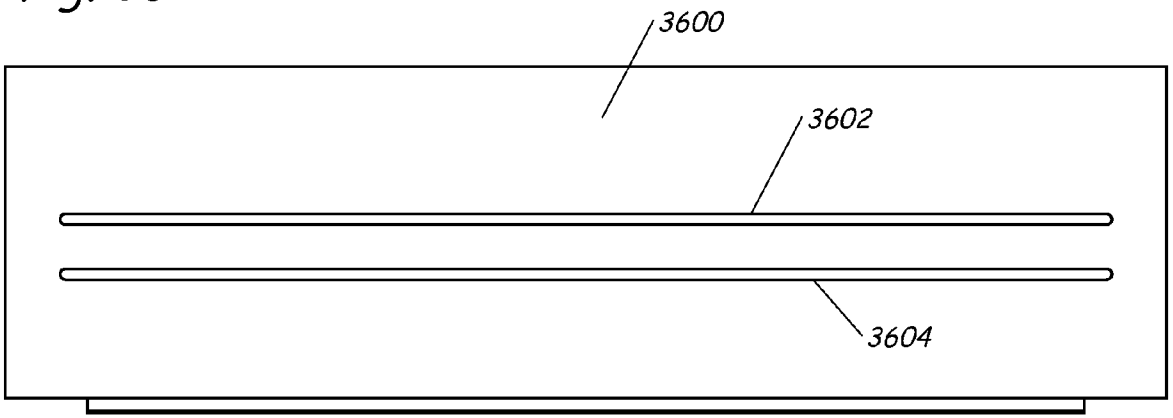

FIGS. 34, 35 and 36 provide examples of covers 3400, 3500 and 3600, respectively. Each of covers 3400, 3500 and 3600 provide a pair of slots with cover 3400 providing slots 3402 and 3404, cover 3500 providing slots 3502 and 3504 and cover 3600 providing slots 3602 and 3604. In cover 3400, slot 3402 is positioned to be aligned with the middle opening of the underlying platform while slot 3404 is positioned to be aligned with the front-most opening of the underlying platform. In cover 3500, slot 3502 is positioned to be aligned with the back-most opening of the underlying platform and slot 3504 is positioned to be aligned with the front-most opening of the underlying platform. In cover 3600, slot 3602 is positioned to be aligned with back-most opening of the underlying platform and slot 3604 is positioned to be aligned with the middle opening of the underlying platform.

Figure 37:
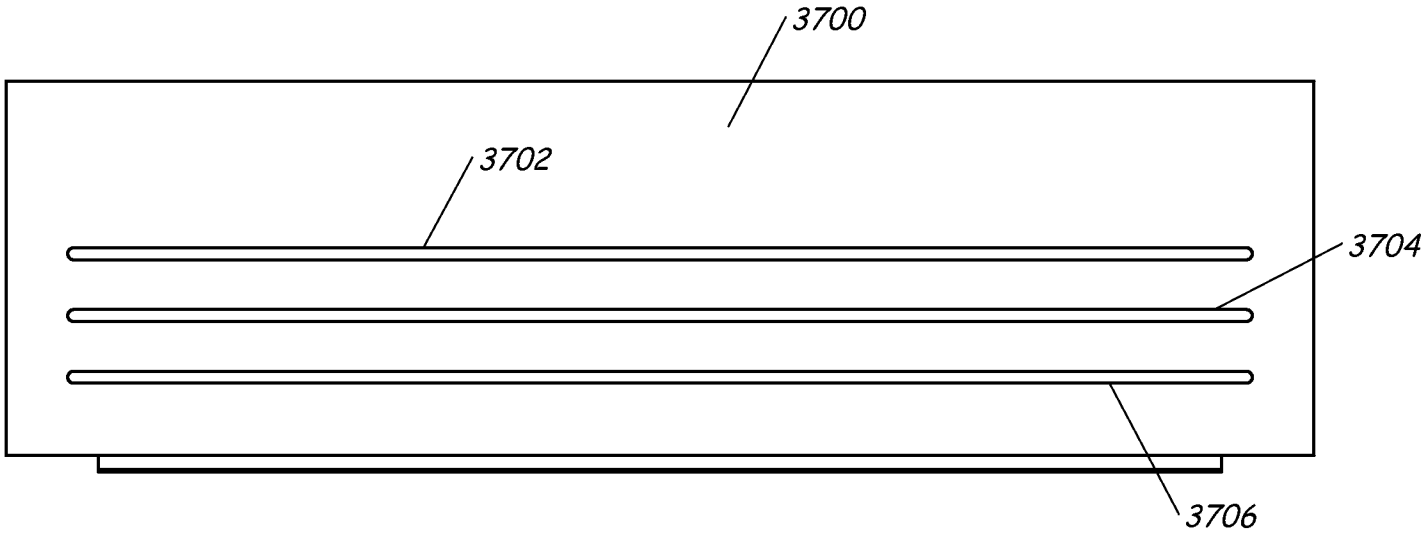

FIG. 37 provides a cover 3700 that includes three slots 3702, 3704 and 3706 with slot 3702 positioned to be aligned with the back-most opening of the underlying platform, slot 3704 positioned to be aligned with the middle opening of the underlying platform and slot 3706 positioned to be aligned with the front-most opening of the underlying platform.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

What is claimed is:

1. A retail shelf unit comprising:

a base including a front rail, a back rail and a pair of side support members that connect the front rail to the back rail and form a perimeter;

a platform having a bottom surface and a plurality of elongated openings extending entirely though the platform;

a cover having a top, a front and at least one elongated slot extending entirely through the top, the cover being positioned over and attached to the platform such that each of the at least one elongated slots of the cover is aligned with one of the elongated openings of the platform; and a linkage connecting the base to the platform and configured to raise and lower the platform so that in a raised position the linkage raises the platform above the base so the platform is oriented along a first substantially horizontal plane and in a lowered position the linkage lowers the platform so the platform is positioned inside the perimeter of the base and the platform is oriented along a second substantially horizontal plane that is substantially parallel with the first substantially horizontal plane, the linkage comprising a base member mounted to the base, a pair of substantially rigid members and an upper member mounted to the platform where each of the pair of substantially rigid members are connected to the base member at pivots points and each of the pair of substantially rigid members are connected to the upper member at pivot points.

2. The retail shelf unit of claim 1 wherein the cover further comprises a label support structure that protrudes from the front of the cover and supports a label holder on the retail fixture, the label holder extending across a width of the platform and a width of the cover.

3. The retail shelf unit of claim 2 wherein the top of the cover comprises a top surface that is positioned above the platform when the cover is positioned over and attached to the platform, a front surface extending down from the top surface and wherein the label support structure protrudes from the front surface.

4. The retail shelf unit of claim 1 wherein the linkage comprises a locking mechanism that locks the platform and the cover in the raised position relative to the base.

5. The retail shelf unit of claim 1 wherein the retail fixture further comprises a label slot formed between a front of the platform and a front of the base and a label strip, wherein the label strip is secured to the retail fixture by a portion of the label strip being positioned within the label slot.

6. The retail shelf unit of claim 1 wherein the platform further comprises a bottom surface having at least one downwardly extending protrusion that extends along at least one of the openings.

7. The retail shelf unit of claim 1 wherein the platform further comprise a bottom surface and a support fixed to the bottom surface, the support having a bottom section spanning each of the plurality of openings and above the bottom section the support having a channel at each opening, wherein each channel of the support has a width that is wider than a width of one of the elongated openings in the platform above the channel.

8. The retail shelf unit of claim 1 wherein a number of slots in the cover is less than a number of openings in the platform.

9. A retail shelf unit comprising:

a base including a front rail, a back rail and a pair of side support members that connect the front rail to the back rail and form a perimeter;

a platform coupled to the base and having a top surface, a bottom surface opposite the top surface, a pair of opposing side ends, at least one elongated opening that extends entirely through the product support from the top surface to the bottom surface and having a width that extends between the pair of opposing side ends and a protrusion downwardly protruding from the bottom surface and extending along and adjacent to at least the width of the at least one elongated opening and having a set of spaced apart nubs; and a cover over the top surface that has at least one elongated slot extending entirely through the cover and is aligned with at least one of the elongated openings.

10. The retail shelf unit of claim 9 further comprising a plurality of elongated openings that extend between the pair of opposing side ends and a plurality of protrusions downwardly protruding from the bottom surface and extending along and adjacent to at least the width of each elongated opening and each of the plurality of protrusions having a set of spaced apart nubs.

11. The retail shelf unit of claim 10 further comprising a support extending transverse to the openings and fixed to the bottom surface, the support having a channel with an upper span and a lower span, the upper span of the channel spanning a set of spaced-apart nubs and an opening and the lower span of the channel being greater than the upper span.

12. The retail shelf unit of claim 9 wherein a number of elongated slots in the cover is less than a number of elongated openings in the top surface.

13. The retail shelf unit of claim 9 further comprising two raising members that are positioned on opposite sides of the top surface and support the product support in a raised position.

14. The retail shelf unit of claim 13 wherein at least one raising member further comprise a catch that must be released in order to lower the top surface.

15. A retail shelf unit comprising:

a base including a front rail, a back rail and a pair of side support members that connect the front rail to the back rail and form a perimeter;

a support structure coupled to and located within the perimeter of the base having an elongated opening extending entirely through the support structure and between a top surface and a bottom surface of the support structure;

a bracket extending across the elongated opening and mounted to the bottom surface of the support structure, the bracket having a channel aligned with the opening that has a first width proximate the bottom surface and a second width distal from the bottom surface wherein the second width is wider than the first width; and a product post mounted to the top surface of the support structure and a fastening mechanism passing through the elongated opening and fastening the product post to the support structure, the fastening mechanism comprising a narrow portion and a wide portion, the wide portion being wider than the first width of the bracket and narrower than the second width.

16. The retail shelf unit of claim 15 further comprising an overlay set on the top surface and having a second elongated opening that is aligned with the elongated opening of the support structure.

17. The retail shelf unit of claim 16 wherein the elongated opening of the support structure comprises a plurality of parallel elongated openings extending between the top surface and the bottom surface and wherein the overlay comprises fewer elongated openings than the elongated openings in the support structure.

18. The retail shelf unit of claim 16 wherein the overlay further comprises a sign support structure that supports a sign such that a top surface of the sign is in a same plane as a top surface of the overlay.

19. The retail shelf unit of claim 15 further comprising a series of position keys protruding from the bottom surface along the opening and defining positions where a product holder may be fastened.

20. The retail shelf unit of claim 15 further comprising a linkage with a locking mechanism that maintains the support structure in a raised position.

* * * * *